US008721268B2

(12) United States Patent
Moore et al.

(10) Patent No.: US 8,721,268 B2
(45) **Date of Patent: *May 13, 2014**

(54) TURBOMACHINE

(75) Inventors: Simon Moore, Metham (GB); Tom J. Roberts, Huddersfield (GB); Robert L. Holroyd, Halifax (GB); James Alexander McEwen, Brighouse (GB)

(73) Assignee: Cummins Ltd., Huddersfield (GB)

( * ) Notice: Subject to any disclaimer, the term of this patent is extended or adjusted under 35 U.S.C. 154(b) by 732 days.

This patent is subject to a terminal disclaimer.

(21) Appl. No.: 12/899,279

(22) Filed: Oct. 6, 2010

(65) Prior Publication Data

US 2011/0110766 A1 May 12, 2011

(30) Foreign Application Priority Data

Oct. 6, 2009 (GB) ..... 0917513.4
Apr. 6, 2010 (GB) ..... 1005680.2
Jul. 30, 2010 (GB) ..... 1012774.4

(51) Int. Cl.
*F01B 25/02* (2006.01)
*F04D 29/44* (2006.01)

(52) U.S. Cl.
USPC ..... 415/158; 415/183

(58) Field of Classification Search
USPC ..... 415/151, 157, 158, 160, 165, 166, 167, 415/183, 184, 185, 186, 191, 203, 204, 206
See application file for complete search history.

(56) References Cited

U.S. PATENT DOCUMENTS 5,092,126 A 3/1992 Yano
5,267,829 A 12/1993 Schmidt et al.

(Continued)

FOREIGN PATENT DOCUMENTS

JP 05-133238 A 5/1993
JP 2007192130 A 8/2007
JP 2008-095613 A 4/2008
WO 2011042739 A2 4/2011

OTHER PUBLICATIONS

European Patent Office, International Search Report and Written Opinion, PCT/GB2010/051672, Cummins Ltd., Sep. 9, 2011.
UKIPO Search Report, Aug. 23, 2010, GB1012774.4.
UKIPO Search Report, May 4, 2011, GB1016701.3.

*Primary Examiner* — Edward Look
*Assistant Examiner* — Christopher J Hargitt
(74) *Attorney, Agent, or Firm* — Krieg DeVault LLP; Clifford W. Browning

(57) ABSTRACT

A variable geometry turbine comprises a turbine wheel mounted for rotation about a turbine axis within a housing, the housing defining an annular inlet surrounding the turbine wheel and defined between first and second inlet sidewalls; and a cylindrical sleeve axially movable across the annular inlet to vary the size of a gas flow path through the inlet; wherein the annular inlet is divided into at least three axially offset annular inlet portions by two or more axially spaced annular baffles disposed between the first and second inlet sidewalls; inlet vanes extending axially into at least one of the inlet portions and defining circumferentially adjacent inlet passages; and wherein each of at least two of said baffles extends radially inboard of inlet vanes which extend into at least one of the inlet portions axially adjacent the respective baffle, and wherein a distance between an inner diameter of a first baffle of said at least two of said baffles and a trailing edge of a radially innermost vane in one of said annular inlet portions adjacent the first baffle is greater than a distance between an inner diameter of a second baffle of said at least two of said baffles and a trailing edge of a radially innermost vane in one of said annular inlet portions adjacent the second baffle.

12 Claims, 17 Drawing Sheets

(56) References Cited

U.S. PATENT DOCUMENTS 7,428,814 B2 * 9/2008 Pedersen et al. ..... 60/602
8,186,943 B2 * 5/2012 Fledersbacher et al. ..... 415/158
2007/0177349 A1 8/2007 Pokharna et al.
2007/0209361 A1 9/2007 Pedersen et al.
2008/0223039 A1 9/2008 Sumser et al.

* cited by examiner

TURBOMACHINE

CROSS REFERENCE TO RELATED APPLICATIONS

The present application claims priority to United Kingdom Patent Application No. 1012774.4 filed Jul. 30, 2010, United Kingdom Patent Application No. 1005680.2 filed Apr. 6, 2010, and United Kingdom Patent Application No. 0917513.4 filed Oct. 6, 2009, each of which is incorporated herein by reference.

The present invention relates to a variable geometry turbine. The variable geometry turbine may, for example, form a part of a turbocharger.

Turbochargers are well known devices for supplying air to an intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to an engine intake manifold. The turbocharger shaft is conventionally supported by journal and thrust bearings, including appropriate lubricating systems, located within a central bearing housing connected between the turbine and compressor wheel housings.

The turbine stage of a typical turbocharger comprises: a turbine chamber within which the turbine wheel is mounted; an annular inlet defined between facing radial walls arranged around the turbine chamber; an inlet volute arranged around the annular inlet; and an outlet passageway extending from the turbine chamber. The passageways and chamber communicate such that pressurised exhaust gas admitted to the inlet volute flows through the inlet to the outlet passageway via the turbine and rotates the turbine wheel. It is also known to improve turbine performance by providing vanes, referred to as nozzle vanes, in the inlet so as to deflect gas flowing through the inlet. That is, gas flowing through the annular inlet flows through inlet passages (defined between adjacent vanes) which induce swirl in the gas flow, turning the flow direction towards the direction of rotation of the turbine wheel.

Turbines may be of a fixed or variable geometry type. Variable geometry turbines differ from fixed geometry turbines in that the size of the inlet can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level which ensures efficient turbine operation by reducing the size of the inlet using a variable geometry mechanism. Turbochargers provided with a variable geometry turbine are referred to as variable geometry turbochargers.

Nozzle vane arrangements in variable geometry turbochargers can take different forms. In one type, known as a "sliding nozzle ring", the vanes are fixed to an axially movable wall that slides across the inlet passageway. The axially movable wall moves towards a facing shroud plate in order to close down the inlet passageway and in so doing the vanes pass through apertures in the shroud plate. Alternatively, the nozzle ring is fixed to a wall of the turbine and a shroud plate is moved over the vanes to vary the size of the inlet passageway.

The moving component of the variable geometry mechanism, whether it is the nozzle ring or the shroud plate, is supported for axial movement in a cavity in a part of the turbocharger housing (usually either the turbine housing or the turbocharger bearing housing). It may be sealed with respect to the cavity walls to reduce or prevent leakage flow around the back of the nozzle ring.

The moveable wall of the variable geometry mechanism is axially displaced by a suitable actuator assembly comprising an actuator and a linkage. An example of such a known actuator assembly is for instance disclosed in U.S. Pat. No. 5,868,552. The linkage comprises a yoke pivotally supported within the bearing housing and having two arms, each of which extends into engagement with an end of a respective push rod on which the moving component (in this instance the nozzle ring) is mounted. The yoke is mounted on a shaft journaled in the bearing housing and supporting a crank external to the bearing housing which may be connected to the actuator in any appropriate manner. The actuator which moves the yoke can take a variety of forms, including pneumatic, hydraulic and electric forms, and can be linked to the yoke in a variety of ways. The actuator will generally adjust the position of the moving wall under the control of an engine control unit (ECU) in order to modify the airflow through the turbine to meet performance requirements.

In use, axial forces are imported on the moveable wall by the air flow through the inlet, which must be accommodated by the actuator assembly. In addition, a torque is imparted to the nozzle ring as a result of gas flow vane passages being deflected towards the direction of rotation of the turbine wheel. If the nozzle ring is the moving wall of the variable geometry mechanism this torque also has to be reacted or otherwise accommodated by the actuator assembly such as by parts of the linkage.

It is one object of the present invention to obviate or mitigate the aforesaid disadvantages. It is also an object of the present invention to provide an improved or alternative variable geometry mechanism and turbine According to an aspect of the present invention there is provided a variable geometry turbine comprising a turbine wheel mounted for rotation about a turbine axis within a housing, the housing defining an annular inlet surrounding the turbine wheel and defined between first and second inlet sidewalls; and a cylindrical sleeve axially movable across the annular inlet to vary the size of a gas flow path through the inlet; wherein the annular inlet is divided into at least three axially offset annular inlet portions by two or more axially spaced annular baffles disposed between the first and second inlet sidewalls; inlet vanes extending axially into at least one of the inlet portions and defining circumferentially adjacent inlet passages; and wherein each of at least two of said baffles extends radially inboard of inlet vanes which extend into at least one of the inlet portions axially adjacent the respective baffle.

The at least two baffles which extend radially inboard of inlet vanes may have different internal diameters.

According to another aspect of the invention there is provided a variable geometry turbine comprising a turbine wheel mounted for rotation about a turbine axis within a housing, the housing defining an annular inlet surrounding the turbine wheel and defined between first and second inlet sidewalls; and a cylindrical sleeve axially movable across the annular inlet to vary the size of a gas flow path through the inlet; wherein the annular inlet is divided into at least three axially offset annular inlet portions by two or more axially spaced annular baffles disposed between the first and second inlet sidewalls; inlet vanes extending axially into at least one of the inlet portions and defining circumferentially adjacent inlet passages; and wherein each of at least two of said baffles extends radially inboard of inlet vanes which extend into at least one of the inlet portions axially adjacent the respective baffle, and wherein a distance between an inner diameter of a first baffle of said at least two of said baffles and a trailing edge of a radially innermost vane in one of said annular inlet portions adjacent the first baffle is greater than a distance between an inner diameter of a second baffle of said at least two of said baffles and a trailing edge of a radially innermost vane in one of said annular inlet portions adjacent the second baffle.

Said one of said annular inlet portions adjacent the first baffle may be axially displaced from the first baffle in a first direction and wherein said one of said annular inlet portions adjacent the second baffle may be axially displaced from the second baffle in the first direction.

At least two baffles which extend radially inboard of inlet vanes in a respective adjacent inlet portions may have different inner diameters.

The axial profile formed by the inner diameters of at least two baffles which extend radially inboard of inlet vanes in a respective adjacent inlet portion may generally correspond to an axial profile of a surface that would be swept by the rotation of the turbine wheel.

The relative inner diameters of at least three baffles which extend radially inboard of inlet vanes in a respective adjacent inlet portion may generally increase in an axial direction.

At least two of the at least two of said baffles may have an inner diameter such that the radial distance relative to the turbine axis between the inner diameter of the baffle and the trailing edge of a radially innermost vane of an inlet portion adjacent the baffle is more than generally 50%, generally 60%, generally 70%, generally 80%, generally 95% or generally 90% of the radial distance between the trailing edge of said radially innermost vane and the outer diameter of the turbine wheel at the axial position of the baffle.

According to another aspect of the present invention there is provided a variable geometry turbine comprising a turbine wheel mounted for rotation about a turbine axis within a housing, the housing defining an annular inlet surrounding the turbine wheel and defined between first and second inlet sidewalls; and a cylindrical sleeve axially movable across the annular inlet to vary the size of a gas flow path through the inlet;

wherein the annular inlet is divided into at least two axially offset annular inlet portions by one or more axially spaced annular baffles disposed between the first and second inlet sidewalls; inlet vanes extending axially into at least one of the inlet portions and defining circumferentially adjacent inlet passages; and wherein at least one of the one or more baffles extends radially inboard of inlet vanes which extend into at least one of the inlet portions axially adjacent the respective baffle, and wherein at least one of said at least one of the one or more baffles has an inner diameter such that the radial distance relative to the turbine axis between the inner diameter of the baffle and the trailing edge of a radially innermost vane of an inlet portion adjacent the baffle is more than generally 50% of the radial distance between the trailing edge of said radially innermost vane and the outer diameter of the turbine wheel at the axial position of the baffle.

The radial distance relative to the turbine axis between the inner diameter of the baffle and the trailing edge of a radially innermost vane of an inlet portion adjacent the baffle may be more than generally 60%, generally 70%, generally 80%, generally 90% or generally 95% of the radial distance between the trailing edge of said radially innermost vane and the outer diameter of the turbine wheel at the axial position of the baffle.

A variable geometry turbine may comprise two or more axially spaced inlet baffles which axially divide the annular inlet into three or more annular regions, wherein inlet vanes extend across at least three of said annular regions.

At least some inlet vanes may extend across the full width of the annular inlet between the inboard and outboard side walls. For instance, an annular array of inlet vanes may extend across the annular inlet between the inboard and outboard side walls and two or more annular inlet baffles may be axially spaced within the annular inlet which together with the vanes define three or more axially spaced annular arrays of inlet passages.

Some variable geometry turbines which include inlet vanes as mentioned above, may be such that the trailing edges of at least a majority of vanes extending across an annular portion of the inlet may lie on a radius greater than the internal radius of a baffle defining the annular portion.

In some variable geometry turbines all of the vanes extending across an annular portion of the inlet may have a trailing edge lying at a radius greater than the internal radius of a baffle defining the annular portion. In some embodiments each annular baffle may have an internal radius smaller than the radius of the leading edge of any vane of the annular inlet.

At least some of the vanes extending across a first annular portion of the inlet may have a configuration different to at least some of the vanes extending across a second annular portion of the inlet The trailing edges of at least some of the vanes extending across a first annular portion of the inlet may lie on a different radius to the trailing edges of at least some of the vanes extending across a second annular portion of the inlet. In some embodiments the trailing edges of all of the vanes extending across a first annular portion of the inlet lie on a radius different to that of the trailing edges of all of the vanes extending across a second annular portion of the inlet. In some embodiments the trailing edges of vanes of one annular portion of the inlet lie on a minimum radius which is different to that of vanes extending across any other annular portion of the inlet.

The annular inlet may be defined downstream of a surrounding volute (including a divided volute or similar chamber for delivering gas flow to the annular inlet). The effective axial width of the inlet is defined between the free end of the sleeve and either the inboard or outboard sidewalls (depending on which side of the housing the sleeve is mounted).

Specific embodiments of the present invention will now be described, with reference to the accompanying drawings.

Figure 3:
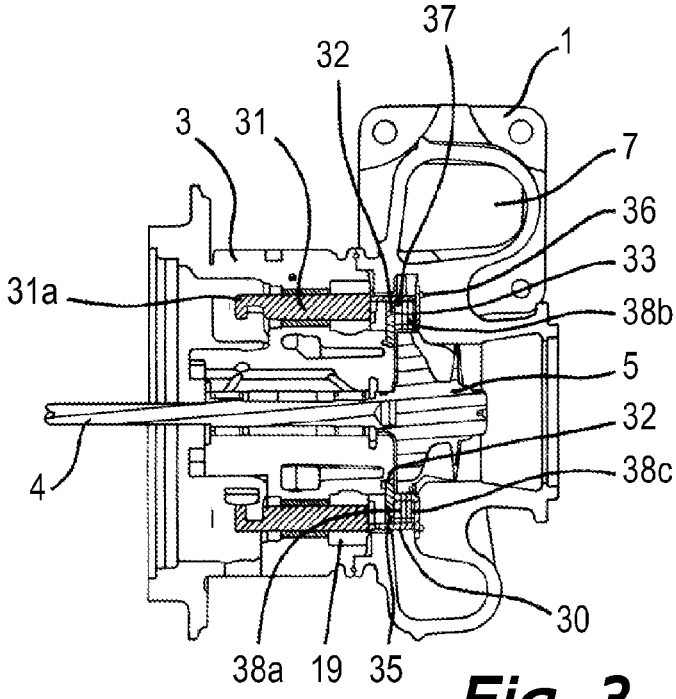
FIG. 3 is an axial cross-section through part of a turbocharger including a variable geometry turbine in accordance with an embodiment of the present invention.
Figure 4A:
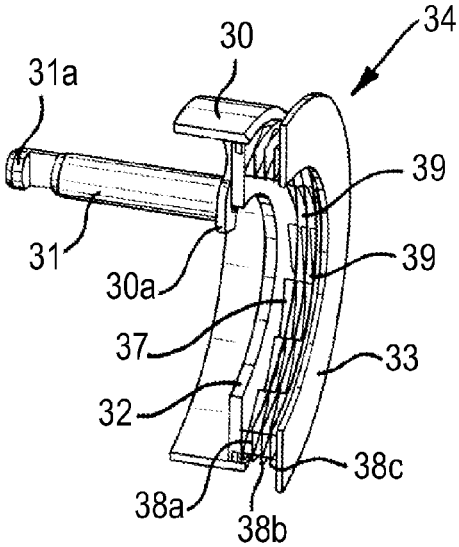
Figure 4B:
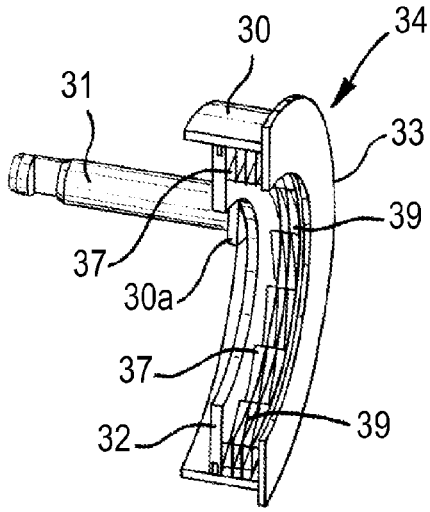

FIGS. 4*a* and 4*b* illustrate detail of the nozzle assembly of the turbine of FIG. 3.

Figure 5:
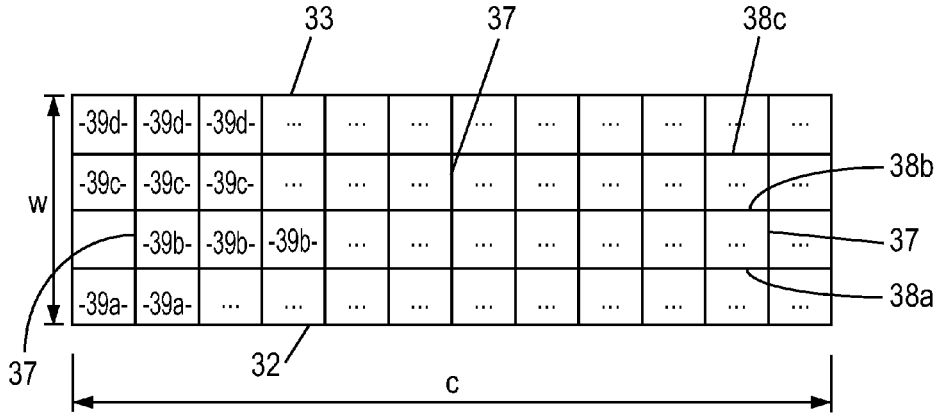

FIG. 5 is a schematic representation of a radial view around a portion of the circumference of the annular inlet of the nozzle assembly of FIGS. 4*a* and 4*b*.

Figure 6:
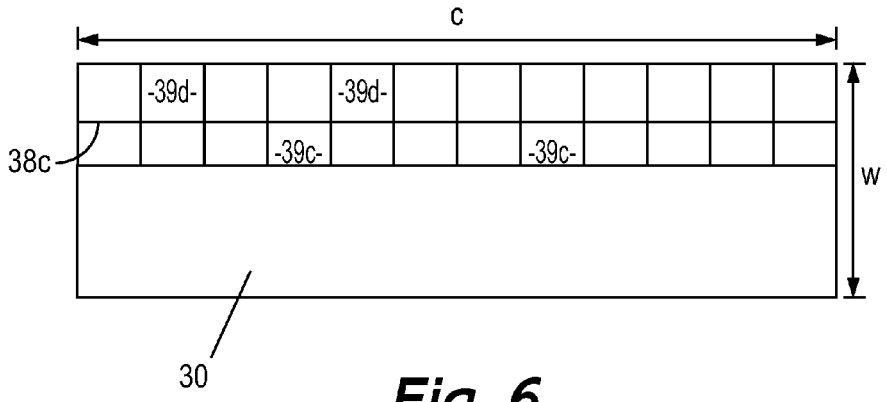

FIG. 6 shows the schematic illustration of FIG. 5 modified to show a sleeve forming part of the nozzle assembly of FIGS. 4*a* and 4*b*.

FIGS. 7*a* to 7*d* are axial cross-sections through part of a variable geometry turbine in accordance with alternative embodiments of the present invention.

Figure 8A:
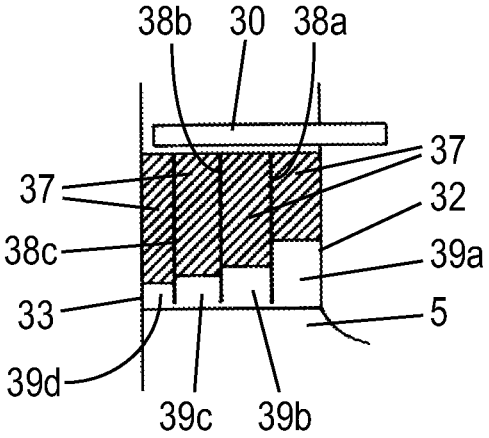
Figure 8B:
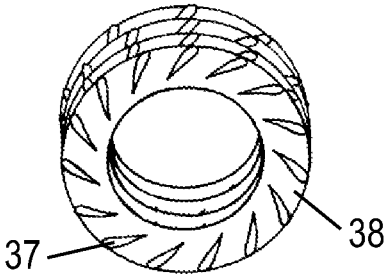
Figure 8C:
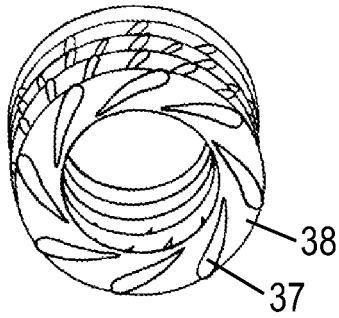

FIGS. 8*a*-8*c* are schematic illustrations of further embodiments of the present invention.

Figure 9:
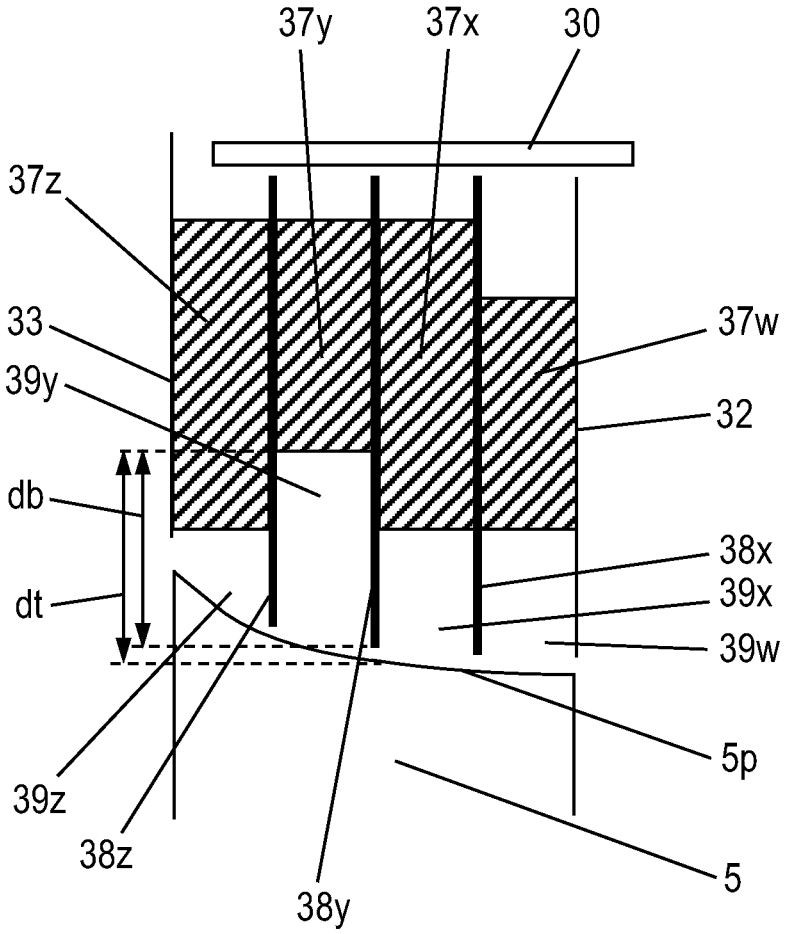

FIG. 9 shows a schematic illustration of a further embodiment of the present invention.

FIGS. 10*a* to 10*f*, 11*a* to 11, 12, and 13*a* to 13*d* are each schematic illustrations of a radial view around a portion of the circumference of a respective inlet structure in accordance with various embodiments of the present invention.

Figure 14A:
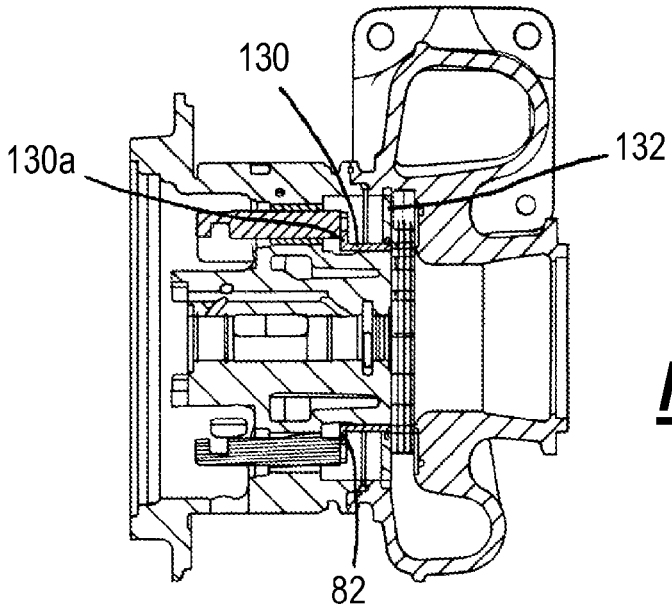
Figure 14B:
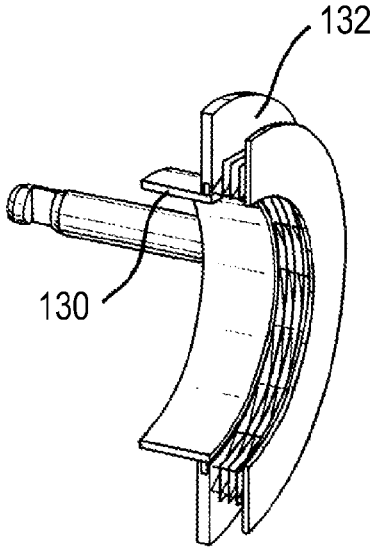
Figure 14C:
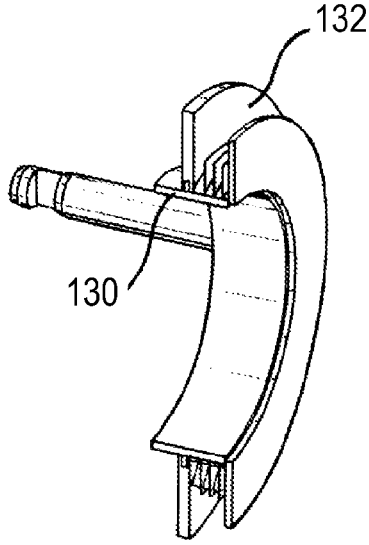

FIGS. 14*a* to 14*c* illustrate a further embodiment of the present invention.

Figure 15A:
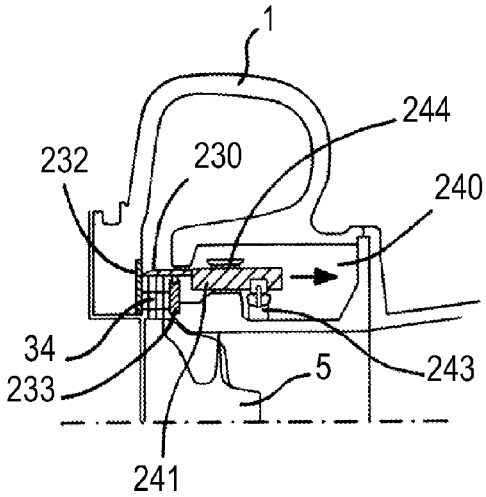
Figure 15B:
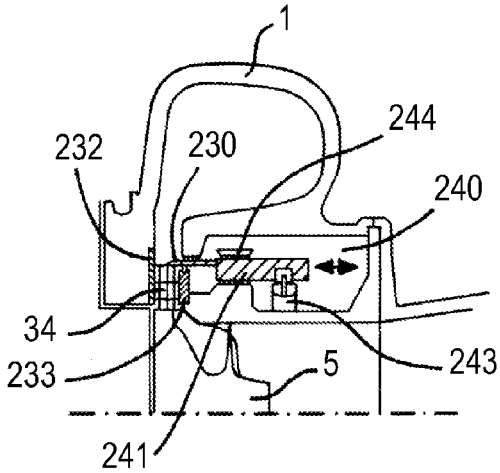

FIGS. 15*a* and 15*b* are axial cross-sections through part of a turbine in accordance with another embodiment of the present invention.

Figure 16A:
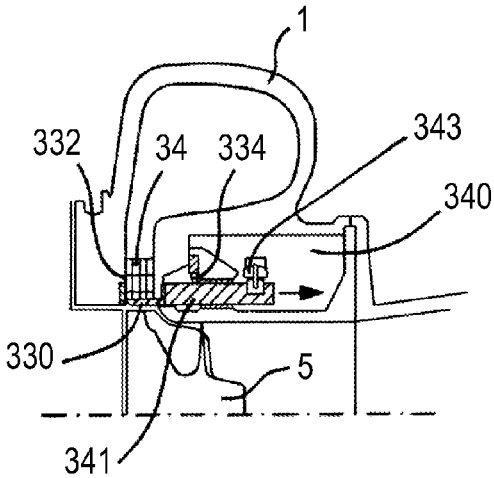
Figure 16B:
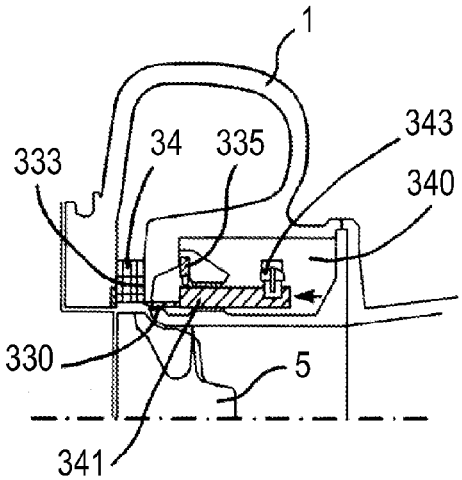

FIGS. 16*a* and 16*b* are axial cross-sections through part of a turbine in accordance with another embodiment of the present invention.

Figure 17A:
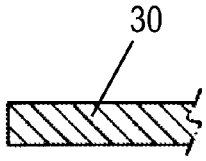
Figure 17B:
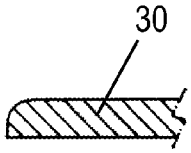
Figure 17C:
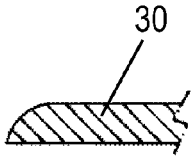

FIGS. 17*a* to 17*c* illustration a detail of a inlet sleeve in accordance with embodiments of the present invention.

Figure 18A:
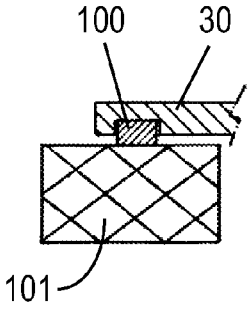
Figure 18B:
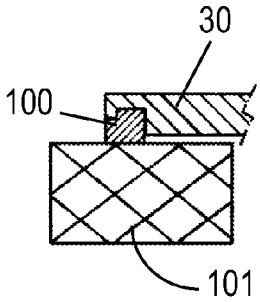

FIGS. 18*a* and 18*b* schematically illustrate a detail of possible modifications to embodiments of the present invention.

Figure 1:
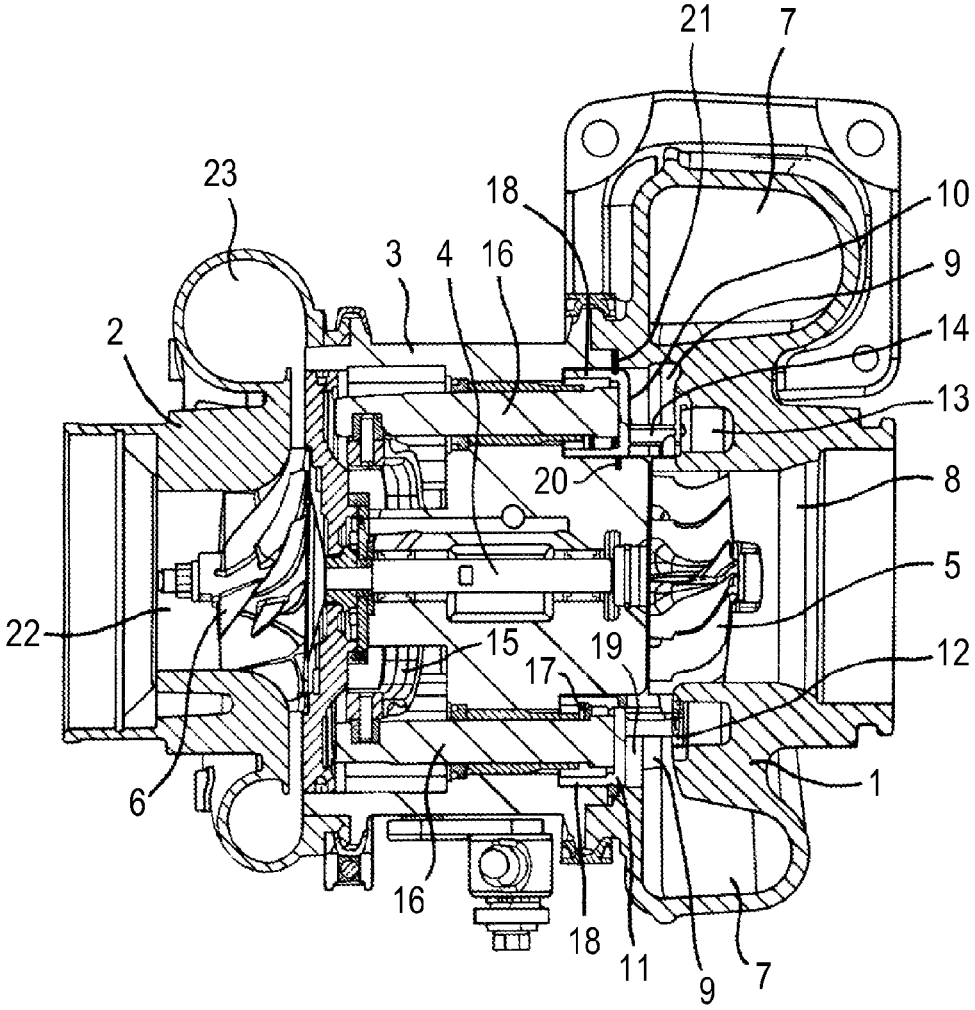
FIG. 1 is an axial cross-section through a known turbocharger including a variable geometry turbine.

Referring to FIG. 1, this illustrates a known turbocharger comprising a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing.

The turbine housing 1 defines a volute 7 to which gas from an internal combustion engine (not shown) is delivered. The exhaust gas flows from the volute 7 to an axial outlet passageway 8 via an annular inlet 9 and turbine wheel 5. The inlet 9 is defined between sides walls, one side wall being surface 10 of a radial wall of a movable annular nozzle ring wall member 11 and on the opposite side wall being an annular shroud plate 12. The shroud 12 covers the opening of an annular recess 13 in the turbine housing 1.

The nozzle ring 11 supports an array of circumferentially and equally spaced nozzle vanes 14 each of which extends across the full axial width of the inlet 9. The nozzle vanes 14 are orientated to deflect gas flowing through the inlet 9 towards the direction of rotation of the turbine wheel 5. When the nozzle ring 11 is proximate to the annular shroud 12, the vanes 14 project through suitably configured slots in the shroud 12, into the recess 13.

An actuator (not shown) is operable to control the position of the nozzle ring 11 via an actuator output shaft (not shown), which is linked to a stirrup member 15. The stirrup member 15 in turn engages axially extending guide rods 16 that support the nozzle ring 11. Accordingly, by appropriate control of the actuator (which may for instance be pneumatic or electric or any other suitable type), the axial position of the guide rods 16 and thus of the nozzle ring 11 can be controlled. It will be appreciated that details of the nozzle ring mounting and guide arrangements may differ from those illustrated.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet volute 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown). The speed of the turbine wheel 5 is dependent upon the velocity of the gas passing through the annular inlet 9. For a fixed rate of mass of gas flowing into the inlet 9, the gas velocity is a function of the width of the inlet 9, the width being adjustable by controlling the axial position of the nozzle ring 11. (As the width of the inlet 9 is reduced, the velocity of the gas passing through it increases.) FIG. 1 shows the annular inlet 9 fully open. The inlet passageway 9 may be closed to a minimum by moving the nozzle ring 11 towards the shroud 12.

Figure 2:
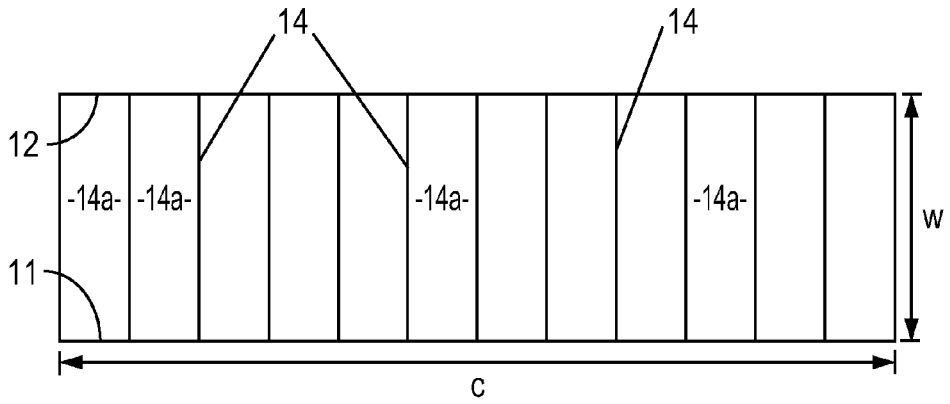
FIG. 2 is a schematic representation of a radial view around a portion of the circumference of the annular inlet of the turbine illustrated in FIG. 1.

Referring to FIG. 2, this is a schematic representation of a radial view around a portion of the circumference of the annular inlet 9 of the turbine of FIG. 1, un-rolled and laid flat in the plane of the paper. In this representation the nozzle ring 11 is in a fully open position such that parallel lines 11 and 12 represent the nozzle ring 11 and shroud plate 12 respectively, and parallel lines 14 represent the leading edges of the nozzle vanes 14 which extend across the inlet 9. The dimension c is a portion of the circumference of the inlet 9, and the dimension w is the maximum width of the annular inlet 9. From FIG. 2 it can be seen that the vanes 14 divide the annular inlet 9 into an annular array of circumferentially adjacent inlet passages 14*a*. Each inlet passage 14*a* extends generally radially, but with a forward sweep (with decreasing radius) resulting from the configuration of the vanes 14 which as mentioned above is designed to deflect the gas flow passing through the inlet 9 towards the direction of rotation of the turbine wheel. The geometry of each of the inlet passages 14*a*, which extend across the full width w of the inlet 9, is defined by the configuration and spacing of the vanes 14, but as shown have a generally rectangular cross-section.

FIG. 3 is a cross-section through part of a turbocharger including a variable geometry turbine in accordance with an embodiment of the present invention. Where appropriate corresponding features of the turbochargers of FIG. 1 and FIG. 3 are identified with the same reference numbers. References to "axial" and "axially" are to be understood as referring to the axis of rotation of the turbine wheel. FIG. 3 shows the bearing housing 3 and turbine housing 4 of the turbocharger, with the compressor (not shown) removed. As with the known turbocharger of FIG. 1, a turbocharger shaft 4 extends through the bearing housing 3 to the turbine housing 1 and a turbine wheel 5 is mounted on one end of the shaft 4 within the turbine housing 1. The turbine housing 1 defines a volute 7 from which exhaust gas flow is delivered to an annular inlet 9 which surrounds the turbine wheel 5.

In accordance with the present invention, the size of the inlet 9 is variable by controlling the position of an axially sliding cylindrical sleeve 30 which is supported on guide rods 31 which are slidably mounted within a cavity 19 defined by the bearing housing 3. The guide rods 31 may have a configuration substantially the same as that of the guide rods 16 illustrated in FIG. 1, and be actuated in the same way via a yoke (not shown) linked to inboard ends 31*a* of the guide rods 31. Outboard ends 31*a* of the guide rods 31 are connected to radially extended flanges 30*a* of the sleeve 30. Respective separate flanges 30*a* maybe provided for connection to the guide rods 31 as illustrated, or the sleeve 30 may comprise a single annular radially extending flange which is connected to the guide rods 31. The sleeve 30 has a free end which projects into the inlet 9 so that the width of the inlet can be varied in a controlled manner by appropriate movement and positioning of the sleeve 30 via the guide rods 31.

Also in accordance with the present invention the inlet 9 is, at least in part, defined between facing side walls of the turbine housing which in this embodiment comprise nozzle rings 32 and 33 of a nozzle assembly 34. The nozzle assembly 34 is shown in greater detail in FIGS. 4*a* and 4*b* (together with a section of the sleeve 31, and a guide rod 31). The first nozzle ring 32 of the nozzle assembly 34 extends radially across the opening of the cavity 19 of the turbine housing to the sleeve 30. Seal ring 35 seals the nozzle ring 32 with respect to the sleeve 30 to prevent gas leakage between the inlet 9 and the cavity 19. Similarly, a seal ring 36 seals the nozzle ring 32 with respect to the turbine housing adjacent a radial inner periphery of the nozzle ring 32. The second nozzle ring 33 of the nozzle ring assembly 34 is fixed to a radial wall of the turbine housing, within a shallow annual recess defined by the turbine housing and is sealed with respect thereto by seal ring 36 to prevent gas leakage between the nozzle ring 33 and the turbine housing.

An annular array of circumferentially equispaced nozzle vanes 37 extend between the first and second nozzle rings 32 and 33. The nozzle vanes 37 divide the annular inlet into circumferentially spaced inlet portions. Radially extending annular inlet baffles 38*a*, 38*b* and 38*c* are axially equispaced between the nozzle rings 32 and 33 and further divide the annular inlet 9 into axially spaced inlet portions. The baffles 38 are relatively thin rings coaxial with the turbine axis and orientated parallel to the nozzle rings 32 and 33 so that they have radially extending faces. Accordingly, the vanes 37 together with the inlet baffles 38*a*-38*c* divide the annular inlet 9 into a plurality of discreet inlet passages 39 (not all of which are individually referenced in the drawings) which is best illustrated in FIG. 5 which is a schematic representation of a radial view of an un-rolled portion of the circumference of the nozzle assembly 34 corresponding to the representation of the known inlet structure shown in FIG. 2. Again the dimension w is the full width of the inlet 9 and the dimension c is a portion of the circumference of the inlet.

Referring to FIG. 5, the vanes 37, and inlet baffles 38*a*-38*c*, divide the inlet 9 into four axially spaced annular arrays of circumferentially spaced inlet passages 39*a*, 39*b*, 39*c* and 39*d* respectively. In contrast, the known arrangement of FIG. 2 has a single annular array of circumferentially spaced inlet passages, each of which extends across the full width of the inlet 9. The exact configuration of the inlet passages 39*a* to 39*d* is defined by the configuration of the vanes 37 and baffles 38*a* to 38*c*, but as illustrated it can be seen that the passages have a generally rectangular (in this case nearly square) cross section. Each of the inlet passages 39*a*-39*d* directs gas flow to the turbine wheel, and due to the sweep of the vanes 37 turns the gas flow in a direction towards to the direction of the rotation of the turbine wheel 5. In this embodiment the inlet passages 39 in each annular array are circumferentially adjacent and each annular array 39*a* to 39*d* is axially adjacent to the next.

As described above, the size of the inlet 9 is controlled by adjustment of the axial position of the sleeve 30 which slides over the outside diameter of the vanes and baffles. Depending upon the positioning of the sleeve 30, one or more of the axially spaced annular arrays of inlet passages 39*a*-39*d* may therefore be blocked or partially blocked to gas flow through the inlet 9. For instance, FIG. 4*a* illustrates the sleeve 30 in an almost fully open position in which the first annular array of gas flow passages 39*a* is partially blocked to gas flow, and the second to fourth annular arrays of inlet passages 39*b*-39*d* are fully open to gas flow. FIG. 4*b* (and FIG. 3), show the sleeve 30 in a fully closed position in which the end of the sleeve 30 bears against the nozzle ring 33 and all four of the axially adjacent annular arrays of inlet passages 39*a*-39*d* are closed (subject to the potential for a minimum amount of leakage into the inlet passages 39*d* between the sleeve 30 and the nozzle ring 33).

By controlling the position of the sleeve 30 between the open and closed positions, a selected number of the axially adjacent annular arrays of inlet passages 39*a*-39*d* may be opened or blocked, or partially opened/blocked. For instance, by positioning the sleeve 30 so that the free end of the sleeve is axially aligned with the first inlet baffle 38*a*, the first annular array of inlet passages 39*a* is closed and the second to fourth annular arrays of inlet passages 39*b*-39*d* are fully opened to gas flow. Similarly, by positioning the free end of the sleeve 30 part way between inlet baffles 38*b* and 38*c* the first and second annular arrays of inlet passages 39*a* and 39*b* will be fully closed, the fourth annular array of inlet passage 39*d* will be fully open and the third annular array of inlet passages 39*c* will be partially open. This is schematically illustrated in FIG. 6 which superimposes the sleeve 30 on the view shown in FIG. 5.

In the embodiments of the invention described above (and below) the sleeve 30 can fully close the inlet, i.e. block the inlet 9 completely. In other embodiments the sleeve need not necessarily be capable of closing the inlet fully, but might have a "closed" position in which the final array of passages 39 is at least partially open. For instance, the free end of the sleeve could be provided with axially extending lands which provide a hard stop for the closed position of the sleeve, with flow gaps defined between lands around the circumference of the sleeve.

In this embodiment of the invention, the increased acceleration of the gas flow is achieved by reducing the size of the inlet 9 occurs upstream of the inlet passages 39. In the absence of inlet baffles 38, gas accelerating past the end of the sleeve 30 will expand axially across the full width of the inlet 9 before it reaches the turbine wheel 5. This would result in substantial loss of energy in the gas flow as it passes through the inlet which may largely negate the desired effect of constricting the inlet. Accordingly, such a variable geometry turbine could be expect to be very inefficient and thus impractical for many applications, such as for instance for use in a turbocharger turbine. With the present invention, as the sleeve 30 moves beyond the first and subsequent inlet baffles, the volume of the inlet 9 within which the gas can expand is reduced which similarly reduces the potential for loss in energy by expansion of the gas flow within the inlet 9 upstream of the turbine wheel. This in turn significantly improves the efficiency of the inlet. As the free end of the sleeve aligns with a given inlet baffle it is effectively equivalent to a moving radial wall member. Between these locations it is possible there may be a drop off in efficiency but this will not be to the same extent as would be experienced in the absence of any inlet baffles. Surprisingly, simulations suggest that the inlet structure of the present invention has even better efficiency than some known moving wall inlet structures, particularly at smaller inlet widths.

The embodiment of the invention illustrated in FIGS. 3 to 6 has three inlet baffles 38, but more or less than three baffles could be incorporated in alternative embodiments. For instance, provision of only a single inlet baffle, for example midway between the nozzle rings 32 and 33, may improve efficiency above that attainable in the absence of any inlet baffle to a sufficient extent to provide an effective variable geometry turbine structure for use in a turbocharger and other applications.

Efficiency of the turbine inlet can be expected to vary in a somewhat step-wise function of inlet size corresponding to the location of the or each inlet baffle. This effect can however be smoothed by increasing the number of baffles. Although increasing the number of baffles (which have an axial thickness) may increase aerodynamic drag and reduce the maximum cross-sectional flow area available to gas flow for any given inlet width w, this may, if necessary, be compensated by constructing the annular inlet 9 to have a larger maximum axial width and than would be the case in the absence of baffles.

The turbine according to the present invention also has a number of other advantages over the known moving nozzle ring turbine shown in FIG. 1. With the present invention there are considerably reduced pressure and aerodynamic forces on the sleeve compared to those acting on a radial wall. For instance, the axial force imposed on the sleeve 30 by air flow through the inlet is much less than that imposed on a moveable radial wall. This allows the use of a smaller, less robust actuator, and also a less robust linkage between the actuator and the sleeve, as the axial force required to move the sleeve and hold it in position is much less than that required to control the position of a radial wall. The reduction in axial forces on the sleeve compared to those experienced by a radial wall also simplifies accurate control of the size of the inlet.

Employing a cylindrical sleeve as the moving component for varying the inlet size, instead of a moving radial wall, also avoids the need to provide slots to receive the vanes as the inlet width is reduced, which is a requirement of known inlet structures comprising a moving nozzle ring (as illustrated for instance in FIG. 1) and also of alternative known structures in which the vanes are fixed and a slotted shroud is moved axially over the vanes to vary the inlet width. The present invention thus eliminates many of the interface requirements between the moving component and the vane array which in turn increases manufacturing tolerances. Absence of such slots also reduces the possibility of gas leakage around the vane array and simplifies sealing requirements.

Known devices comprising a moveable nozzle ring in which the moving wall member includes the vanes, for instance as shown in FIG. 1, also experience significant torque as the gas flow is deflected by the vanes. With the present invention there is no such torque on the moving component which further reduces the force on the actuator and actuator linkages.

With the embodiment of the invention illustrated in FIGS. 3 and 4, the inlet passages 39 are defined by a nozzle assembly 34 comprising the nozzle rings 32 and 33 which support the inlet vanes 37 and baffles 38. The nozzle rings 32 and 33 thus define the sidewalls of the annular inlet 9 of the turbine. This structure may have advantages such as allowing differently configured nozzle assemblies to be fitted to a common turbine housing so that the inlet structure (i.e. configuration of inlet passages 39) may be varied between turbines which are otherwise substantially identical. This (modular) construction may have manufacturing benefits. However, it will be appreciated that the vanes 37 and baffles 38 which define the passages 39 (or any other structure which may define the inlet passages 39 as described below), need not be formed in a separable modular nozzle assembly, but could be cast or machined integrally with the turbocharger housing (e.g. the bearing housing and/or turbine housing in a typical turbine structure). In such embodiments, sidewalls of the inlet 9 need not be formed by discreet nozzle rings as with the embodiments of FIGS. 3 and 5. Accordingly, although in the description below reference numerals 32 and 33 are conveniently used to identify sidewalls of a turbine inlet 9, these are not to be considered limited to the nozzle rings 32 and 33.

In the embodiment of the invention illustrated in FIGS. 3-6, the turbine nozzle comprises three inlet baffles 38, but as mentioned above there may be more or less inlet baffles in alternative embodiments of the invention. For instance, embodiments with only one or two inlet baffles are effective in significantly increasing the efficiency of a turbine inlet in which the moving component used to vary the inlet size is a cylindrical sleeve surrounding the vane array. Similarly, embodiments with more than three baffles may be advantageous in some embodiments. In some applications, such as for instance turbocharger applications, it is expected that 3 to 6 baffles would be appropriate.

The baffles need not be axially equi-spaced across the width of the inlet 9, and in the case of a single baffle this need not be located mid-way between side walls of the inlet 9. For instance, the axial spacing between any two adjacent baffles, or between a baffle and an adjacent side wall of the inlet may increase or decrease from one axial side of the inlet to the other, or may first increase and then decrease, or vice versa. For instance, where there is more than one inlet baffle, the axial space between the adjacent baffles and between any baffle and a side wall of the inlet may reduce/increase across the inlet 9 so that as the inlet is progressively closed by the cylindrical sleeve, the axial width of any exposed inlet passages 39 reduces/increases.

In the embodiment of the invention illustrated in FIGS. 3-6, each of the inlet baffles comprises a radially extending wall of constant thickness so that opposing surfaces of each baffle lie in a radial plane. In addition, facing surfaces of each baffle are parallel both to one another and to the facing surfaces of the nozzle rings 32 and 33 which defined the side walls of the annular inlet 9. In alternative embodiments of the invention the opposing surfaces of any given baffle need not be parallel to one another and/or need not lie in a radial plane, and/or need not be parallel to the facing surface of an adjacent baffle or inlet side wall.

For example, one or both of the opposing surfaces of a single inlet baffle may lie on a frusto-conical surface of revolution about the turbine axis. Such surfaces may be parallel with one another, or may angle in opposing directions. In embodiments comprising a plurality of frustoconical baffles, adjacent baffles may have facing surfaces which are parallel to one another or which lie at an angle to one another. Similarly, the inlet side walls, (e.g. nozzle rings 32 and 33) may have surfaces which may be parallel or angled to the facing surfaces of adjacent inlet baffles.

An inlet baffle may have a uniform axial thickness, or may have a thickness which varies across its radius. For instance, a baffle may have a narrowing axial thickness with decreasing radius. For instance, an inlet baffle may taper or may have a radial cross section which is has an aerofoil shape similar to that of a conventional inlet vane.

Examples of some of the possible alternatives described above are shown in FIGS. 7*a* to 7*g*. These Figures are a simplified radial cross-sections through a turbine inlet 9 comprising sidewalls 11 and 12, and baffles 38. Details of inlet vanes 37 are omitted from some of the figures for simplicity.

Figure 7A:
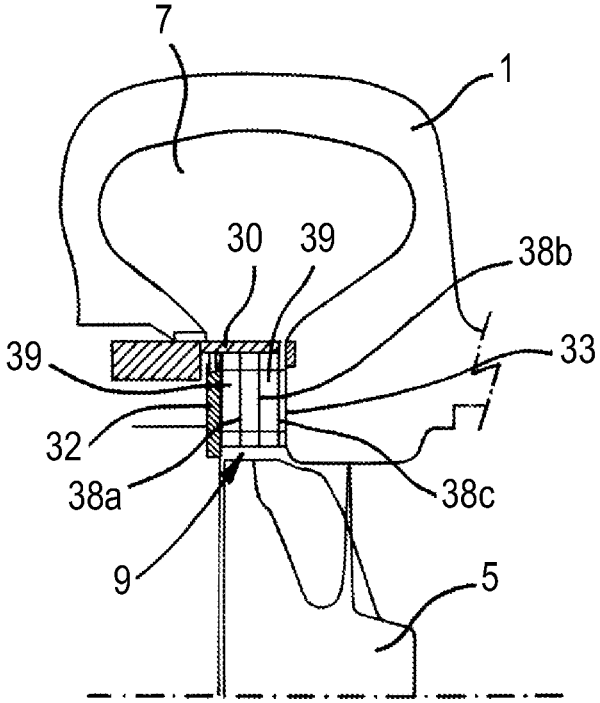

FIG. 7*a* illustrates an embodiment comprising an annular inlet 9 defined between side walls 32 and 33 and comprising a nozzle having three baffles 38*a*-38*c*. In this particular case baffle 38*c* is much closer to side wall 33 than to the neighbouring baffle 38*b*. Similarly the spacing of baffles 38*a* and 38*b*, and the spacing of side wall 32 and baffle 38*a* is greater than the spacing between baffle 38*c* and side wall 33. In this particular embodiment the baffles are radial and parallel to one another as well as to the side walls 32 and 33.

Figure 7B:
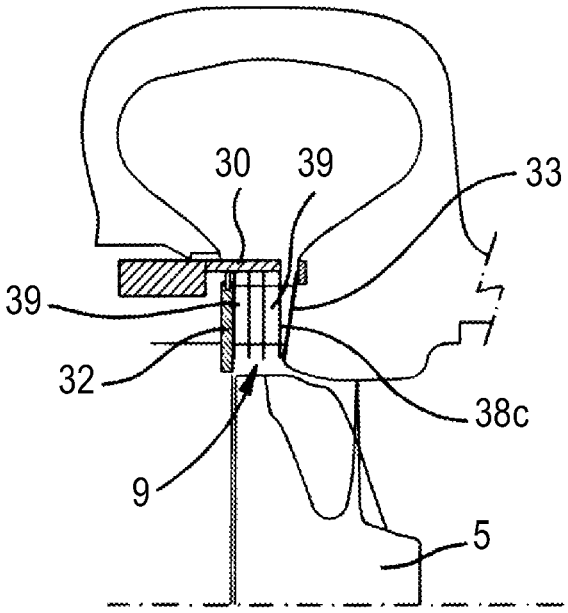

FIG. 7*b* is a modification of the structure shown in FIG. 7*a*, in which the side wall 33 of the turbine housing 1 lies of a frusto-conical surface so is angled with respect to the baffle 38*c*. In alternative embodiments the side wall 32 could be angled in a similar way, and in some embodiments both side walls 32 and 33 may be angled so that both sides of the annular inlet 9 taper inwardly.

Figure 7C:
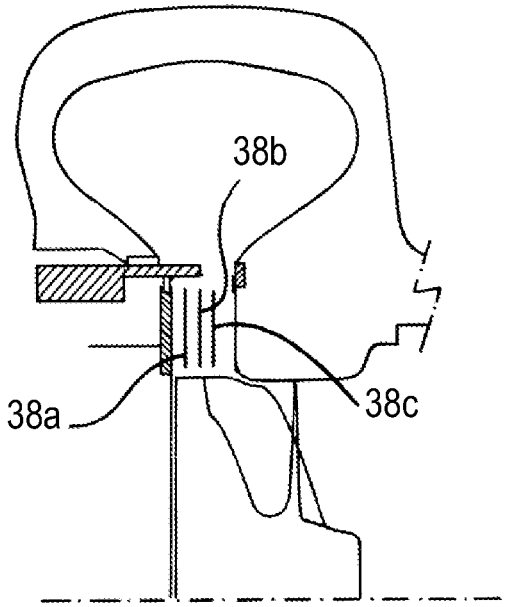

FIG. 7*c* illustrates an embodiment including three inlet baffles 38*a*-38*c* which have progressively increased spacing across the inlet 9, so that as the sleeve 30 is moved to close the inlet the axial width of the inlet passages 39 increases.

Figure 7D:
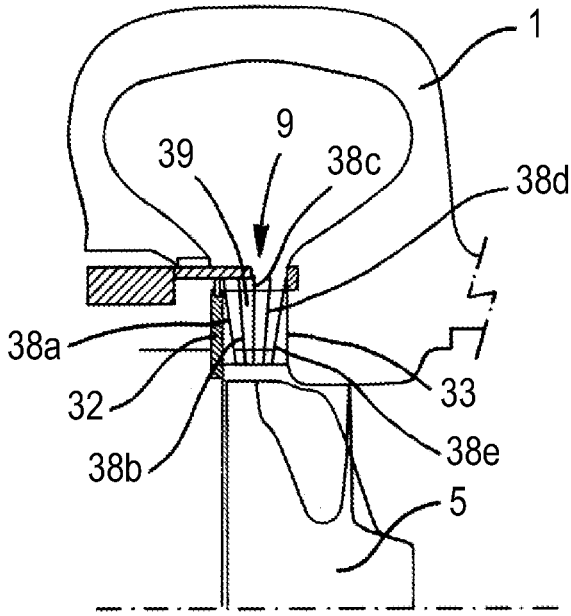

The embodiment of FIG. 7*d*, the inlet nozzle comprises 5 baffles 38*a*-38*e*. As can be seen, in cross-section the baffles have a "fan" arrangement. That is, the central baffle 38*c*, which is mid way between inlet side walls 32 and 33, lies in a radial plane, but nozzle rings 38*a*, 38*b*, and baffles 38*d* and 38*e* are inclined so that they each lie on a frusto-conical surface with the effect that the inlet passages 39 tend to converge towards the central inlet baffle 38*c*. In addition, the effect is to define a tapering nozzle which has a maximum width defined between the nozzle ring 38*a* and the nozzle ring 38*e*, and which narrows with decreasing radius. In other words, the nozzle tapers inwardly. A similar effect could be achieved by dispensing with nozzle rings 38*a* and 38*e* and inclining the side walls 32 and 33 instead.

The inlet vanes may have any suitable configuration, and may for instance have substantially the same aerofoil configuration of conventional inlet vanes or any alternative configuration selected to define a particular arrangement and configuration of inlet passages 39. That is, since the vanes and inlet baffles together define the configuration and orientation of the inlet passages 39, a wide variety of different inlet passage configurations can be achieved by appropriate design of the configuration and orientation of the individual nozzle vanes or inlet baffles, and moreover the designs can be such that there may be a variety of differently configured inlet passages within a single nozzle assembly.

In the embodiments of the invention described above, each inlet vane may be viewed as comprising axially adjacent inlet vane portions separated by the inlet baffles. Thus, in the illustrated embodiment each vane 37 may be considered to comprise portions which are axially aligned so that they are equivalent to a single vane extending across the full width of the inlet 9. However, in alternative embodiments it may for instance be desirable to circumferentially stagger inlet vane portions between adjacent pairs of inlet baffles, and in some embodiments it may no longer be possible to identify the equivalent of a single vane extending across the full width of the inlet 9.

For example, one possible modification of the embodiment of FIGS. 3 to 6 is illustrated in FIGS. 8*a*-8*c*, and the same reference numerals are used where appropriate. Referring first to FIG. 8*a*, it can be seen that vanes 37 are not continuous across the full width of the inlet 9, but rather vanes defining each of the annular arrays of inlet passages 39*a*-39*d* have different radial extents. Whilst the leading edges of all of the vanes 37 lie on the same outer radius, the radius of the trailing edges of the vanes differ, in that the radial position of the trailing edge of each annular array of vanes decreases progressively from the first annular array 39*a* to the fourth annular array 39*d*. In addition, it can be seen that the inlet baffles 38*a*-38*c* have a greater radial extent than at least some of the vanes 37 (in the illustrated embodiment it is greater than that of any of the vanes). That is, whilst they have substantially the same outer radius as the vanes 37, the inner radius of the baffles 38*a*-38*c* is significantly less than that of the vanes 37, so that the baffles 38*a*-38*c* extend further towards the turbine wheel 5 than the vanes 37. In this particular embodiment each of the baffles 38*a*-38*c* has the same radial dimension but this may not be the case in other embodiments. In addition, embodiments in which the baffles extend closer to the turbine wheel than the vanes may include embodiments in which the vanes all have the same radial extent. To offer a significant turbine efficiency improvement, the baffles preferably have a radial extent greater than 110% of that of at least those vanes that do not extend as close to the wheel as the baffle, more preferably greater than 120%. Where at least some of the gas passages have a relatively radial swirl direction (e.g. at an average angle of greater than 40 degrees to the circumferential direction) the baffles preferably have a radial extent greater than 120% of that of at least those vanes that do not extend as close to the wheel as the baffle, more preferably greater than 140%. Where at least some of the gas passages have a very radial swirl direction (e.g. at an average angle of greater than 60 degrees to the circumferential direction) the baffles preferably have a radial extent greater than 140% of that of at least those vanes that do not extend as close to the wheel as the baffle, more preferably greater than 160%.

Also apparent from FIG. 8*a*, the axial spacing of the inlet baffles 38*a*-38*c* is irregular so that whilst the width of the annular arrays of inlet passages 39*b* and 39*c* is the same, the axial width of the annular array 39*a* is greater than that of 38*b* and 38*c*, and the axial width of annular array 39*d* is less than that of axial arrays 38*b* and 38*c*.

Although not apparent from FIG. 8*a*, but illustrated in FIGS. 8*b* and 8*c*, the number of vanes in each of the annular arrays 39*a* to 39*d* may differ. For instance FIG. 8*b* shows an annular array of fifteen vanes and FIG. 8*c* shows an annular array of only eight vanes which may be included in the same nozzle assembly. Other arrays may have a different number of vanes, greater than fifteen or fewer than eight, or somewhere in between (e.g. twelve). In addition, FIGS. 8*b* and 8*c* show the vanes having different radial extents, and different swirl angles (that is the vanes visible in 8*c* are swept forwards to a greater extent than the vanes shown in FIG. 8*b*, and as such have a greater swirl angle).

The present invention therefore provides a great degree of flexibility in optimising various features of the nozzle to particular requirements and efficiency profiles. For instance, in one embodiment of the invention as illustrated in FIGS. 8*a* to 8*c*, there may be eight vanes in the array 39*d*, twelve vanes in each of the arrays 39*b* and 39*c*, and 15 vanes in the array 39*a*. The swirl angle may be greatest in the array 39*d* and decrease progressively to the array 39*a*. This is just one example and it will be appreciated that many other variations are possible. Various factors may influence the particular nozzle design, which may include minimising turbine high-cycle fatigue (i.e. minimising the forcing function on the blades), and optimising or otherwise tailoring the efficiency and swallowing capacity of the turbine (e.g. providing low efficiency at wide inlet openings which is useful in some applications such as e.g. EGR engines as described below).

For instance, in an embodiment in which the sleeve 30 is actuated from the turbine housing side of the inlet, so that its free end moves towards the bearing housing side of the inlet 9 as the inlet is closed (this possibility is discussed in more detail further below) the arrays of inlet channels 39*c* and 39*d* are less able to stimulate vibration and fatigue in the turbine blades because the hub end of the turbine leading edge is more rigidly connected to the turbine hub (by virtue of it being closer to the turbine wheel back face). In some applications of the invention it may be desirable to maximise turbine efficiency at smaller inlet openings and thus the vane arrays 39*c* and 39*d* may have a reduced clearance with respect of the turbine wheel (as illustrated) to boost efficiency given that this may not result in any significant vibration/fatigue problem as the turbine blades are more rigidly supported in this region. In addition, increasing the swirl angle of the vanes in the array 39*d* can offer a slight efficiency increase when the sleeve is at nearly closed positions (in which the leading edge of the sleeve 30 extends beyond the location of the inlet baffle 38*c*). This would have the additional effect of reducing the rate that the cross-sectional flow area changes as a function of sleeve motion, when the sleeve is nearly closed, which allows the actuator to control the cross-sectional flow area more precisely.

For certain engine applications (such as for EGR) it may be desirable to reduce the turbine efficiency in one or more of the arrays of inlet channels 39*a*-39*d*. For instance, it may be desirable to reduce efficiency at relatively open inlet widths in some applications. Such reduced efficiency could for instance be achieved by reducing the radial extent of the vanes (as illustrated) and/or by increasing the circumferential width or otherwise configured of the vanes to reduce the effective inlet area. The inlet area could be reduced further by providing other obstacles to flow, for instance posts extending axially into the channel. The axial width of the array can be reduced to increase effective friction losses, and the swirl angle of the vanes could be configured to provide mixed swirl. Other examples (not illustrated) could include a ring of similar and evenly spaced posts, two or more concentric rings of posts, a ring of unevenly and randomly distributed posts, or even a ring of vanes arranged to reverse the swirl angle of the gas (i.e. to rotate gas in the opposite direction to the turbine).

FIG. 9 shows a possible modification of the embodiment illustrated in FIGS. 8*a*-8*c*, and the same reference numerals are used where appropriate. As with the embodiment illustrated in FIGS. 8*a*-8*c*, it can be seen that vanes 37*w*-37*z* are not continuous across the full width of the inlet, but rather vanes defining each of the annular arrays of inlet passages 39*w*-39*z* have various configurations. The various configurations of vanes defining each of the annular arrays of inlet passages may be advantageous because in some embodiments it may be desirable for gas passing through the different annular arrays to have different flow characteristics and/or efficiencies depending on the axial location of the annular array.

The leading edges of vanes 37*x*-37*z* lie on the same outer radius, whereas the leading edge of vane 37*w* lies on a different outer radius. The trailing edges of the vanes 37*w*, 37*x* and 37*z* lie on the same inner radius, whereas the trailing edge of vane 37*y* lies on a different inner radius. The radial extent of vanes 37*w* and 37*y* is the same, but different to that of the vanes 37*x* and 37*z*. In addition, it can be seen that the inlet baffles 38*x*-38*z* have a greater radial extent than at least some of the vanes 37 (in the illustrated embodiment it is greater than that of any of the vanes). That is, whilst they have substantially the same outer radius as the vanes 37, the inner radius of the baffles 38*a*-38*c* is significantly less than that of the vanes 37, so that the baffles 38*x*-38*z* extend further towards the turbine wheel 5 than the vanes 37 (i.e. the baffles extend radially inboard of the vanes). In particular, each baffle extends radially inboard of the vanes in the inlet portions axially either side of it. For example, the baffle 38*x* extends radially inboard of the vanes 37*w* and 37*x*. In some embodiments the baffle may extend radially inboard of vanes in only one adjacent inlet portion. The vanes in the other adjacent inlet portion may have a trailing edge which has the same radius (or diameter) as the inner radius (or diameter) of the baffle. It may be advantageous in some embodiments for the baffle to extend radially inboard of vanes in at least one of the adjacent inlet portions, because this limits flow communication and turbulence between axially adjacent inlet portions upstream of the turbine wheel.

In this particular embodiment each of the baffles 38*x*-38*z* has the same outer radial dimension (or outer diameter). In other embodiments at least one of the baffles may have a different outer radial dimension. In this particular embodiment each of the baffles 38*x*-38*z* has a different inner radial dimension (or inner diameter). In other embodiments only some of the baffles may have a different inner radial dimension. The inner radial dimensions (or inner diameters) of the baffles 38*x*-38*z* form a trend whereby the relative inner diameters of the baffles 38*x*-38*z* increase in an axial direction from inlet sidewall 32 to inlet sidewall 33. It will be appreciated that in other embodiments, the inner radial dimensions (or inner diameters) of the baffles may form a trend whereby the relative inner diameters of the baffles decrease in an axial direction from inlet sidewall 32 to inlet sidewall 33. In some embodiments the trend whereby the relative inner radial dimensions (or inner diameters) of the baffles increase/decrease in an axial direction between the inlet sidewalls may only be a general trend. For example, the relative inner radial dimensions (or inner diameters) of the baffles may generally increase in an axial direction between the inlet sidewalls, but at least one of the baffles may have a relative inner radial dimension which falls outside of the trend. A trend whereby the relative inner radial dimensions (or inner diameters) of the baffles increase/decrease in an axial direction between the inlet sidewalls may be advantageous in some embodiments as it may enable the flow characteristics of the gas passing through each inlet portion and being incident on the turbine wheel to vary across the inlet.

In this embodiment, the axial profile formed by the inner radial dimensions (or inner diameters) of the baffles 38*x*-38*z* generally corresponds to the axial profile of the surface 5*p* swept by the rotation of the turbine wheel. In this embodiment, the radial separation between each of the baffles 38*x*-38*z* and the respective radially adjacent portion of the surface 5*p* swept by the rotation of the turbine wheel is generally constant. It will be appreciated that in other embodiments the axial profile of the surface swept by the rotation of the turbine wheel may be different. It will also be appreciated that in some embodiments, only some of the baffles may have inner radial dimensions that form an axial profile which generally corresponds to the axial profile of the surface swept by the rotation of the turbine wheel. Embodiments where the axial profile formed by the inner radial dimensions (or inner diameters) of the baffles generally correspond to the axial profile of the surface swept by the rotation of the turbine wheel may be advantageous in that it enables the characteristics of gas flow through the inlet portions to the turbine wheel which are defined by the separation between the baffle and the turbine wheel to be kept constant across different inlet portions.

In this embodiment it can be seen that each of the baffles 38*x*-38*z* has an inner radial dimension (inner diameter) such that the radial distance relative to the turbine axis between the inner diameter of each baffle and the trailing edge of a vane of an inlet portion adjacent the baffle (which in the case where the vanes have different radial positions, may be a radially innermost vane) is more than generally 50% of the radial distance between the trailing edge of said vane and the outer diameter of the turbine wheel at the axial position of the baffle. For example, referring to baffle 38*y* and adjacent vane 37*y*, the baffle 38*y* has an inner radial dimension (inner diameter) such that the radial distance db relative to the turbine axis between the inner diameter of the baffle and the trailing edge of the adjacent vane 37*y* is more than generally 50% of the radial distance dt between the trailing edge of said vane and the outer diameter of the turbine wheel at the axial position of the baffle. In some embodiments the radial distance relative to the turbine axis between the inner diameter of a baffle and the trailing edge of a vane of an inlet portion adjacent the baffle may be generally 60%, generally 70%, generally 80%, generally 90% or generally 95% of the radial distance between the trailing edge of said vane and the outer diameter of the turbine wheel at the axial position of the baffle. That is to say that the radial distance relative to the turbine axis between the inner diameter of a baffle and the trailing edge of a vane of an inlet portion adjacent the baffle may be generally between 50% and 100%, between 50% and 60%, between 60% and 70%, between 80% and 90%, between 90% and 95% or between 95% and 100% of the radial distance between the trailing edge of said vane and the outer diameter of the turbine wheel at the axial position of the baffle. By ensuring that the radial distance relative to the turbine axis between the inner diameter of a baffle and the trailing edge of a vane of an inlet portion adjacent the baffle is a large proportion of the radial distance between the trailing edge of said vane and the outer diameter of the turbine wheel at the axial position of the baffle, this may help to prevent unwanted expansion of gas passing through the inlet portions before thy pass the turbine wheel. This feature may also help to prevent flow communication and turbulence between adjacent inlet portions upstream of the turbine wheel. Furthermore it may be advantageous in helping to prevent gas flowing from the inlet portions around the turbine wheel, without exerting significant force on the turbine wheel. A practical limit as to how close the baffles can extend towards the outer surface of the turbine wheel may be provided by when the skin effect (due to skin friction caused by the proximity of the turbine wheel to the baffles) negatively affects performance of the turbine wheel.

In the embodiments of the invention described above, each inlet baffle is annular and as such extends around the full circumference of the inlet 9. Each inlet baffle may however be considered to comprise an annular array of adjacent baffle portions defined between adjacent inlet vanes (or vane portions). In the illustrated embodiment of FIGS. 3-6, the baffle "portions" of each baffle 38 are aligned to define the respective annular baffle. However, in alternative embodiments it may for instance be desirable to effectively omit some baffle portions, and in some embodiments it may no longer be possible to identify the equivalent of a single inlet baffle extending annularly around the full circumference of in the inlet 9.

Non limiting examples of various alternative embodiments are illustrated in FIGS. 10*a* to 10*f* and 11*a* to 11*d*. These Figures are schematic radial views of un-rolled portions of the circumference of the respective embodiments corresponding to the views shown in FIGS. 2 and 5 for example.

Figure 10A:
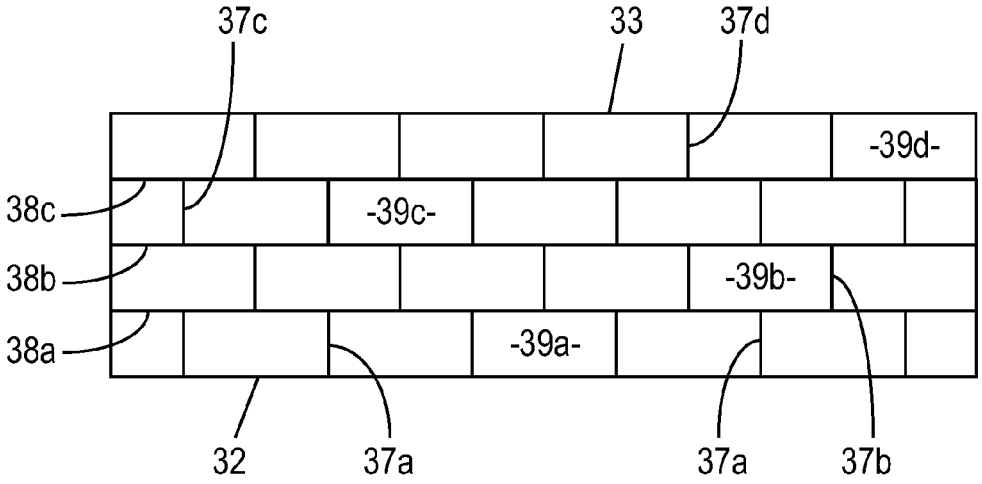

FIG. 10*a* illustrates an embodiment in which inlet vane portions 37*a*-37*d* extend between adjacent inlet baffles 38 and between in the baffles 38 and side walls 32 and 33. No single inlet vane 37 is continuous across a baffle 38, with the effect that individual inlet passages 39 are arranged in circumferentially staggered annular arrays 39*a*-39*b* (there is circumferential overlap between axially adjacent passages 39).

Figure 10B:
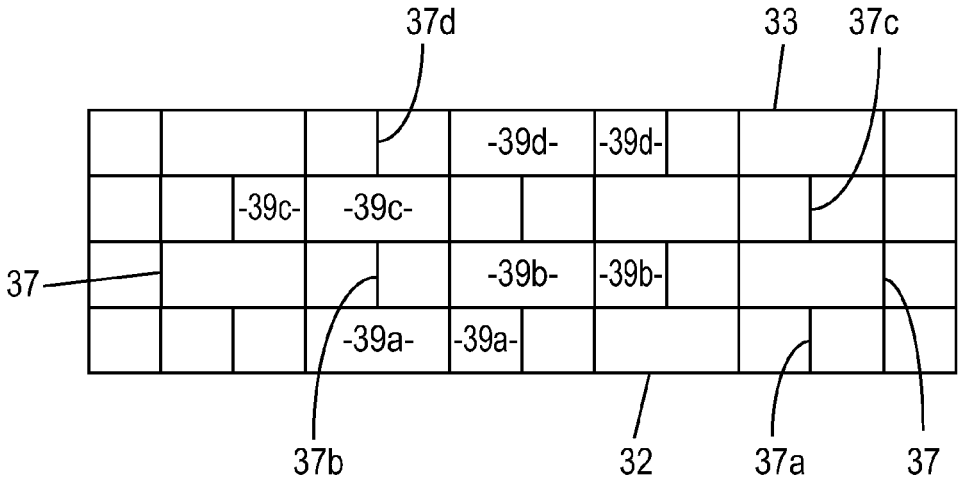

FIG. 10*b* is a modification of the embodiment shown in FIG. 8*a*, in which some vanes 37 do extend across the full width of the inlet 9, whereas other vane portions extend only between neighbouring baffles 38 or between a baffle 38 and enabling inlet wall 32/33. There are again four annular arrays of circumferentially adjacent inlet passages 39*a*-39*d*, but in this case each annular array includes inlet passages 39 of different sizes, in this case some have a rectangular cross-section whereas others have a square cross-section.

Figure 10C:
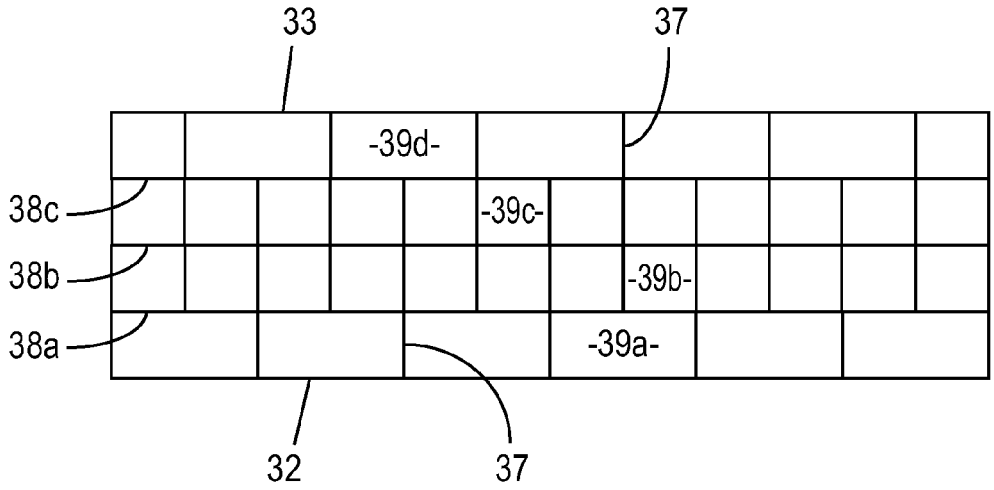

FIG. 10*c* illustrates an embodiment of the invention in which inlet vanes 37 extend from the side walls 32 and 33 respectively, but in which no single inlet vane 37 extends the full width of the inlet 9. The effect in this case is to create four annular arrays of circumferentially adjacent in the passages 39*a*-39*b*, wherein the passages adjacent each side wall 32 and 33 have a rectangular cross-section and the passages 39*b* and 39*c* define between the baffles 38 have a generally square cross-section.

Figure 10D:
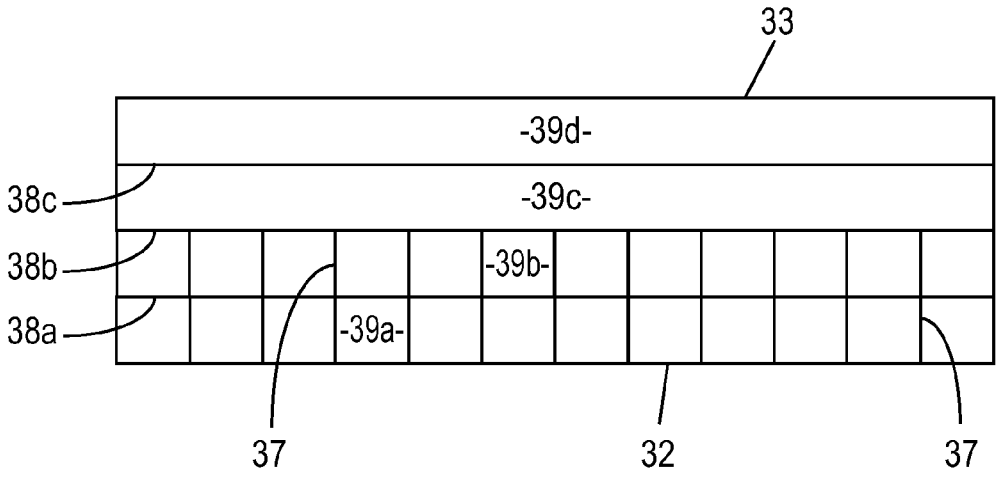

FIG. 10*d* illustrates an embodiment in which inlet vanes 37 extend only half way across the full width of the inlet 9, in this case extending from side wall 32 to a central inlet baffle 38*b*. In this case there only two annular arrays of inlet passages 39*a* and 39*b* whereas the "arrays" of 39*c* and 39*d* are each replaced by a single annular passage way 39*c* and 39*d* respectively.

Although a single 'vaneless' space 39*d* may be provided without any vanes or other structures crossing it, if two vaneless spaces are provided (as shown in FIG. 10*d*) then the baffle separating them will require support. This could for instance be in the form of at least three small axially extending struts spaced around the turbine inlet between that central baffle and a neighbouring baffle or a side wall.

A single vaneless space 19*c* between one of the side walls 32 or 33 and the annular arrays of passages (i.e. at one axial end of the turbine inlet) may be very beneficial. By including a vaneless space to be exposed when the sleeve is fully open, the flow range of the variable geometry turbine can be considerably increased. Optionally the radially outboard inlet of the vaneless space may be axially wider than the radially inboard outlet (not illustrated).

Figure 10E:
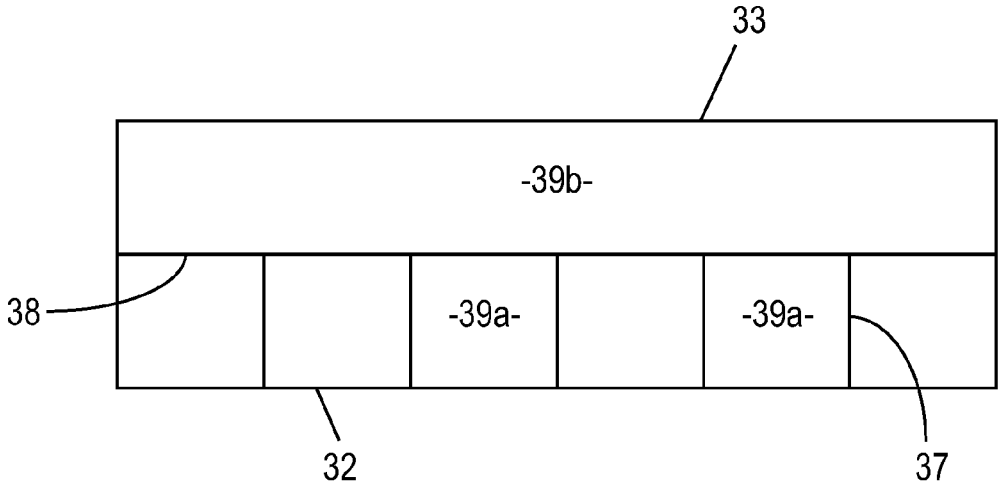
Figure 10F:
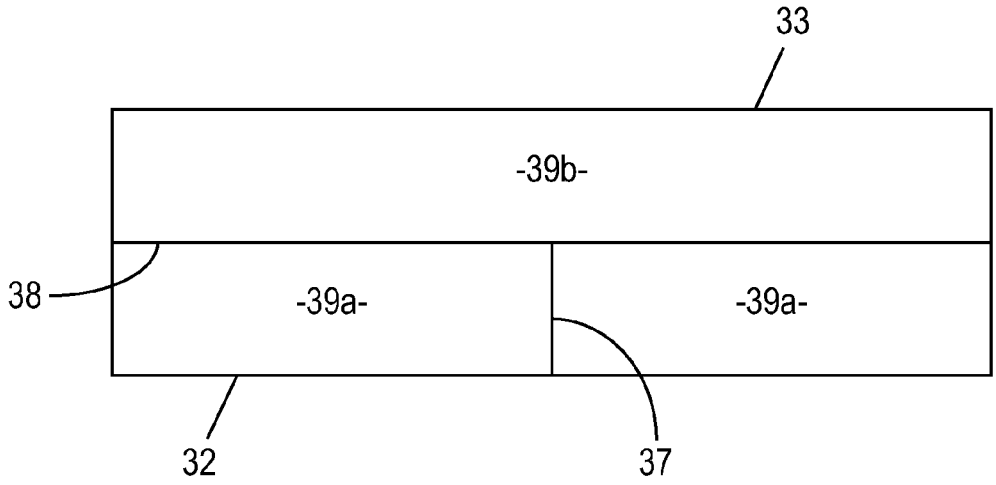

The embodiments of FIGS. 10*e* and 10*f* also comprise at least one annular inlet passage absent any vanes. In the embodiment of FIG. 10*e*, there is a single inlet baffle 38 and vanes 37 extend from side wall 32 to the inlet baffle 38, but do not extend from the inlet baffle 38 to the side wall 33. This creates a first annular array of adjacent inlet passages 39*a* and a single annular inlet passage 39*b*. FIG. 10*f* is an extreme example of the embodiments shown in FIG. 10*e*, in which there is only a single vane 37 shown which extends from side wall 32 to the single inlet baffle 38. Where the Figure shows only a single vane 37 it is to be understood that there is a diametrically opposed vane 37 so that there are two adjacent semi-circular inlet portions 39*a* in a first annular array, and a axially adjacent single annular inlet passageway 39*b*. In practice, there are unlikely to be any applications to the present invention which will require only a single pair of diametrically opposed vanes 37.

In some embodiments there may be at least 6 vanes to help ensure the ends of the vanes are close enough together without being impracticably long and inducing excessive gas friction. This may also help the gas to swirl in relatively homogenously (e.g. constant swirl angle around the circumference) which may be difficult to achieve with fewer than 6 vanes. In some embodiments there may be at least 9 vanes, preferably at least 12 and normally at least 14. For instance, such a turbine inlet could have 9-18 vanes, with very small turbocharger turbines suiting perhaps 13-16 vanes and very large automotive ones suiting perhaps 15-18 vanes.

In some embodiments of the invention the skin friction induced by the baffles may be reduced by reducing the radial extent of the baffles and vanes, and hence reducing the vane length. If necessary or desired the number of vanes can be increased to increase the "vane solidity".

With the materials available at present, and the gas pulsations and temperature variations expected, as many as 30 circumferentially distributed gas passages may for instance be appropriate for some applications of the invention, such as for instance heavy duty engine turbocharger applications. In other embodiments as many as 40 circumferentially distributed gas passages perhaps be appropriate, for instance for light duty engine turbocharger applications. For fuel cell turbocharger applications 75 or more circumferentially distributed gas passages may be desirable (due to the lower exhaust temperatures and absence of gas pulsations). For very large turbines operated at low temperatures, low turbine pressure differentials, low gas speeds, and in the absence of gas pulsations and temperature variations, 100 circumferentially distributed gas passages may appropriate.

Therefore the number of circumferentially distributed gas passages (which may all be at least partially axially overlapping) may generally be between 8 and 100. In other embodiments there may be between 12 and 100, or between 18 and 100 (perhaps 23 and 100, possibly 26 and 100 or conceivably 30 to 100). According to one embodiment of the invention, there may be provided two axially divided annular arrays of gas passages, each annular array having between 12 and 100 circumferentially distributed gas passages.

Such structures with large numbers of circumferentially distributed gas passages are not shown for simplicity, but it should be understood that the structures described herein are examples and the principles described may be implemented with large numbers of circumferentially distributed gas passages optionally between 18 and 100.

It will thus be appreciated that the number of vanes can vary from those illustrated in FIGS. 10*a*-10*f*.

FIGS. 11*a* to 11*d* show embodiments in which vanes 37 extend across the full width of the inlet 9, but at least one or more inlet baffles extend only a part way around the circumference of the inlet.

Figure 11A:
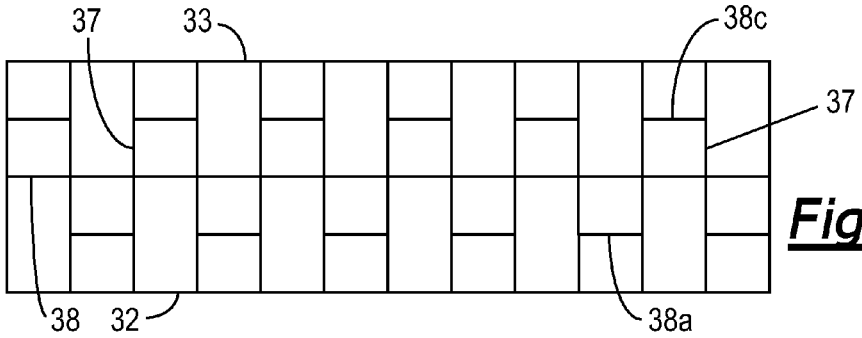

FIG. 11*a* illustrates an embodiment of the invention comprising a single inlet baffle 38 which extends around the full circumference of the inlet 9 (in this case midway between the side walls 32 and 33), and inlet baffle portions 38*a* and 38*c* which extend between other pairs of vanes 37 (which extend across the full width of the inlet 9).

Figure 11B:
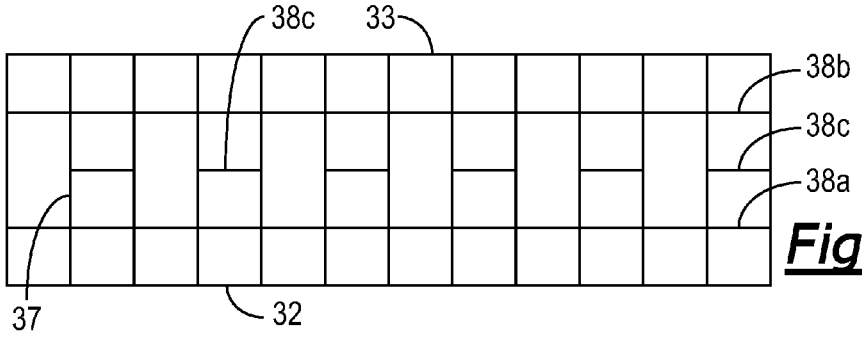

The embodiment of FIG. 11*b* differs from the embodiment of FIG. 11*a* in that there are two baffles 38*a* and 38*d* which extend around the full circumference of the inlet 9, but where baffle 38*c* is split into discontinuous baffle portions extending between every other pair of vanes 37.

Figure 11C:
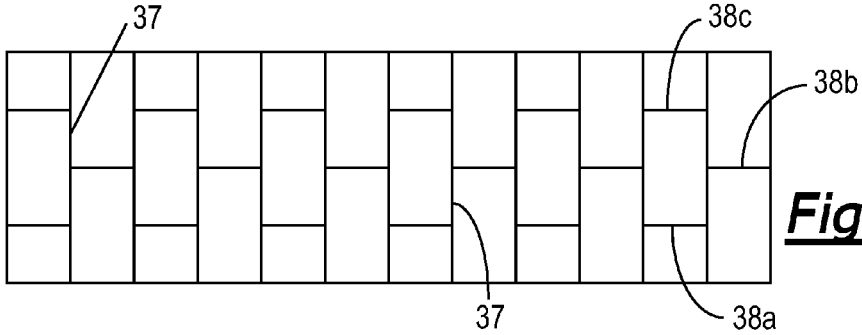

FIG. 11*c* is an embodiment in which there is no single inlet baffle extending the full circumference of the annular inlet 9, rather inlet baffles 38*a*-38*c* comprise baffle portions extending between respective pairs of inlet vanes 37. In the particular embodiment illustrated, the inlet baffle portions 38*b* are circumferentially staggered relative to the inlet baffle portions 38*a* and 38*c*. The individual inlet passages 39 are axially staggered, in that there is axial overlap between circumferentially adjacent passages 39.

Figure 11D:
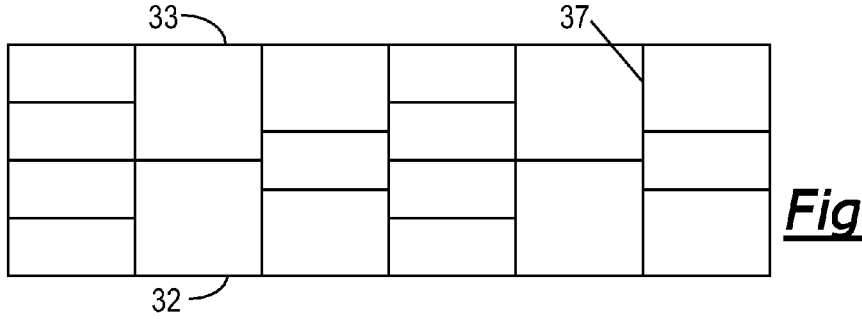

The embodiment of FIG. 11*d* shows another example of a nozzle which has no single inlet baffle extending the full circumference of the annular inlet 9. Moreover, this embodiment shows how the spacing between inlet baffle portions extending between one pair of vanes may differ to that between the baffle portions extending between an adjacent pair of vanes.

Figure 12:
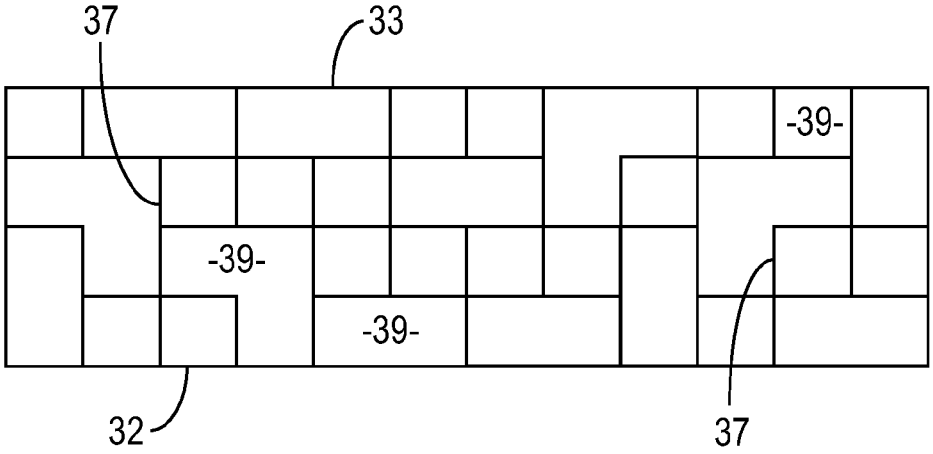

The embodiments of FIGS. 10 and 11 have generally regular arrays of inlet passages 39. However, this need not necessarily be the case. For example, FIG. 12 schematically illustrates an embodiment in which there is no single inlet baffle extending around the full circumference of the inlet, and no single inlet vane extending across the full width of the inlet. In this case the passage array is very irregular. In practice this specific pattern may not be particularly desirable, but it is included to illustrate the extent of variation that can be achieved (subject to manufacturing suitability) with some embodiments of the present invention.

It will be appreciated that the vanes or vane portions of the various embodiments of the invention described above may have any suitable cross-sections or configurations. For instance, the vanes may have a relatively conventional airfoil configuration. In general, it may be advantageous to ensure that the leading edge of each vane has an increased thickness compared with the trailing edge of each vane. Increasing the thickness of the leading edge of the vanes offers higher tolerance to any variations in the incident angle of gas flow impinging on the vanes. That is, depending on the flow/pressure in the turbine volute the direction that gas will impinge on the vanes can vary. If gas hits a simple sheet structure at an angle it may cause the gas flow on the lee-side to separate off from the sheet leaving a vortex/turbulent area which greatly reduces efficiency.

In addition, it will be appreciated that the configuration and/or arrangement of the vanes may vary in order to produce inlet flow passages 39 of a desired configuration. For example, it is generally beneficial for the passages 39 to curve rather than follow a substantially straight path.

In view of the wide variety of possible alternative structures according to the present invention, it may not therefore always be possible to view the inlet nozzle structures as comprising discernable inlet vanes in the conventional sense or even vane portions. Similarly, it may not be possible to identify individual inlet baffles or baffle portions as such. Rather, in more general terms it may be more appropriate to consider the invention as relating to an inlet nozzle structure which defines a plurality of discrete inlet passages which may take a variety of configurations and be arranged in a variety of different ways. Common to all of the embodiments of the invention illustrated in FIGS. 3 to 12, the turbine nozzle comprises at least two axial spaced annular arrays of inlet passages. In some embodiments a single axial "array" may in fact comprise only one circumferential inlet passage. However, in most embodiments it is envisaged that each annular array will comprise many inlet passages circumferentially spaced (e.g. adjacent) around the annular inlet.

In any given embodiment of the invention it may be possible to identify annular arrays of circumferentially spaced inlet passages 39 in different ways. For instance, FIGS. 13*a* to 13*d* show the embodiment of FIG. 9*d*, but with axially spaced annular arrays of circumferentially spaced in the passages 39 identified in different ways. For instance, referring first to FIG. 13*a*, four annular arrays of inlet passages 39*a*-39*d* are identified. In this case, the inlet passages of the first array 39*a* have differing axial widths, but are adjacent one another. The inlet passages 39*b* of a second array each have the same axial width but are staggered relative to one another, and are not always adjacent one another. A third annular array of circumferentially spaced inlet passages 39*c* is identified which have the same axial width and position, but are not adjacent one another. Finally, a fourth annual array of circumferentially spaced inlet passages 39*d* corresponds to the first array 39*a*.

Figure 13A:
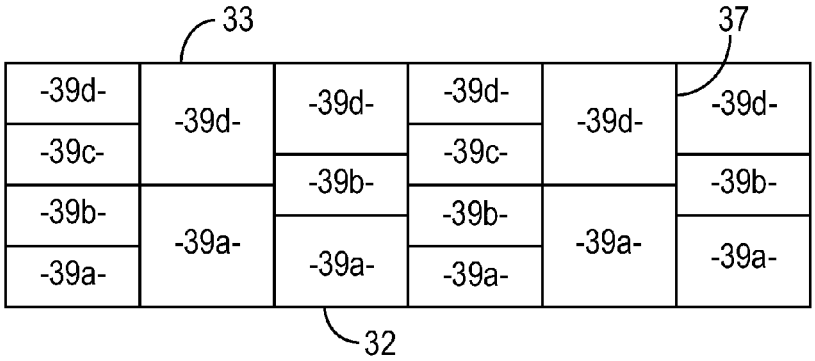
Figure 13B:
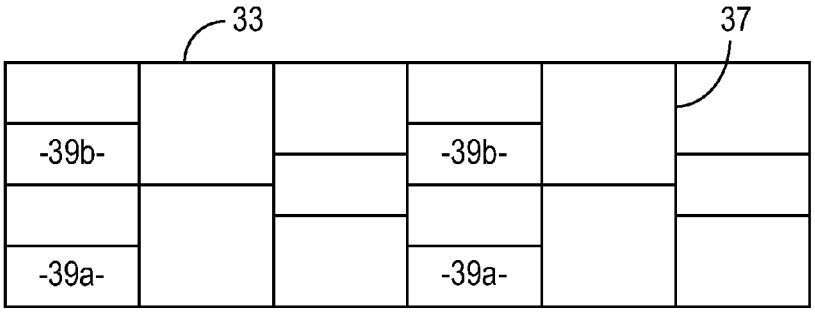
Figure 13C:
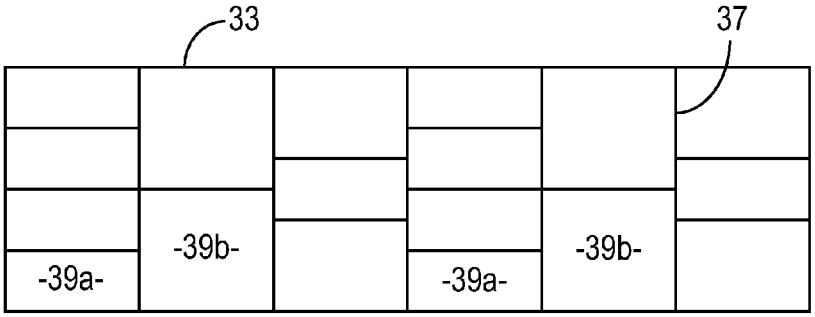
Figure 13D:
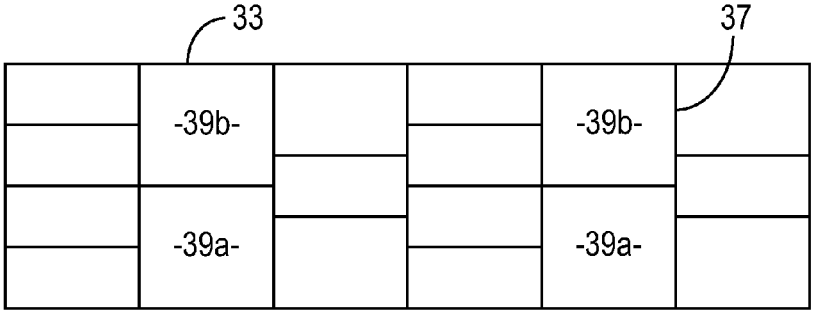

For any particular embodiment of the present invention it may not be necessary to identify more than two distinct axially spaced annular arrays of inlet passages, even when more than two such arrays may exist. For instance, FIG. 13*b* identifies only two annular arrays of spaced inlet passages 39*a* and 39*b*. In this case, the inlet passages in each annular array are neither circumferentially nor axially adjacent one another. In FIG. 13*c* two different annular arrays of circumferentially spaced inlet passages 39*a* and 39*b* are identified. In this case the inlet passages 39*a* of the first array are actually circumferentially adjacent inlet passages 39*b* of the second array, the axial spacing being achieved by an overlap in the axial dimension of the passages of each array. That is to say, the inlet passages 39*b* have a greater axial width than the inlet passages 39*a* so that at least a portion of each inlet passages 39*b* is axially spaced from the inlet passages 39*a*. Finally, FIG. 13*d* shows another approach to identifying two axially spaced annular arrays of inlet passages 39*a* and 39*b*. In this case the passages 39*a* and 39*b* are axially adjacent one another, but the passages 39 of each array are not circumferentially adjacent.

It will be understood that further possible distinct annular arrays of inlet passages according to the present invention can be identified with the embodiment of the invention illustrated in FIG. 13*a*-13*d*, and that similarly in other embodiments of the invention it will be possible to define distinct axially spaced annular arrays of inlet passages in different ways.

In all of the embodiments of the invention illustrated and described above, the inlet nozzle structure comprises a plurality of inlet passages including at least one inlet passage spaced circumferentially and axially respectively from two other inlet passages, or indeed spaced both circumferentially and axially from each of the other two inlet passages. The spacing may be such that at least some of the passages are adjacent one another, and there may be axial and/or circumferential overlap between at least some of the passages. One other way to express this relationship is that in each of the embodiments of the invention illustrated it is possible to identify a first pair of inlet passages that are circumferentially spaced—and possibly adjacent and/or circumferentially overlapping (or staggered), and a second pair of inlet passages which are axially spaced—and possibly adjacent and/or overlapping (or staggered). Depending on how the pairs are identified, in some cases only three passages may be required to define the two pairs, with one inlet passage common to both the first and second pairs.

Embodiments of the invention illustrated show a turbine inlet structure in which the sleeve 30 slides around the outside diameter of the nozzle structure, so that the sleeve acts to block/unblock inlet passages 39 at their upstream ends. However, in alternative embodiments of the invention the cylindrical sleeve may be located on the inside diameter of the nozzle so that it opens and closes inlet passages 39 at their downstream ends adjacent the turbine wheel. For example, FIGS. 14*a* to 14*c* show a modification of the embodiment of the invention illustrated in FIGS. 3 and 4*a*-4*b*, wherein a modified sleeve 130 slides across the inlet passage 9 downstream of inlet passages 39 so that it slides between the nozzle and turbine wheel. Other details of this embodiment of the invention are substantially the same as those shown and described in relation to FIGS. 3 and 4*a*-4*b* and like reference numerals are used where appropriate. The only significant differences are those necessary to accommodate the reduced diameter sleeve 130, namely repositioning of one of the two nozzle rings, identified as nozzle ring 132, and flanges 130*a* to which support rods 31 are connected. In particular, it will be appreciated that each of the various nozzle structures illustrated and described above, and all variations as described above, can be included in embodiments of the invention in which the sleeve 130 is positioned around the turbine wheel at the internal diameter of the inlet nozzle.

Preferentially, the sleeve surrounds the inlet portions, which has been found to give an improved aerodynamic performance. In other words, the inner diameter of the sleeve is greater than an outer diameter (or outer radial extent) of the inlet portion or portions. In another embodiment, the sleeve may be surrounded by the inlet portions. In other words, the outer diameter of the sleeve may be less than inner diameter of the inlet portion or portions. In another embodiment, the sleeve may be moveable through the inlet portion or portions. In other words, the diameter (e.g. inner or outer, or average diameter) of the sleeve may be less than an outer diameter of the inlet portion or portions, and greater than an inner diameter of the inlet portion or portions.

In some embodiments of the invention it may be advantageous to provide two axially slideable sleeves, comprising a first sleeve located around the outside diameter of the inlet passages and a second cylindrical sleeve located at the inside diameter of the inlet passages. In such cases the first and second sleeves may have the same axial extent across the width of the inlet 9, or one of the two sleeves may extend further than the other at least some positions, so that in such positions the overall axial width of the annular inlets differs from its upstream to its downstream openings. The two sleeves could be coupled together (or integral) for actuation as a unit, or may be independently arranged and actuated.

Embodiments of the invention described above show the sleeve 30 and 130 extending across the annular inlet 9 from the bearing housing side of the turbine wheel. In alternative embodiments of the invention the sleeve may extend across the annular inlet 9 from the turbine housing side of the wheel. In other words, the sleeve and actuating mechanism can be housed in the turbine housing rather than in the bearing housing. Examples of such embodiments of the invention are shown in FIGS. 15*a* and 15*b*, and 16*a* and 16*b*.

Actuating the sleeve from the turbine side can be beneficial for mitigating high cycle fatigue of the turbine blades, because when the sleeve is nearly closed, exposing just one ring of inlet passages. When the sleeve is closed from the turbine side, then ordinarily it closes towards the bearing housing side, and towards the rear of the turbine wheel—which is where the blade is most robustly supported by the turbine back face.

Referring first to FIGS. 15*a* and 15*b*, a nozzle assembly is indicated generally by reference 34 and may take any of the variety of forms described above and alternatives thereto. The significant difference between the embodiment of FIGS. 15*a* and 15*b* and for instance the embodiment of FIG. 3 for example, is that a cylindrical sleeve 230 is mounted within a cavity 240 defined in a turbine housing 1 rather than in the bearing housing 3. Notwithstanding this different location of the sleeve 230, so that it slides across the inlet 9 from the turbine side to the bearing housing side, the manner of mounting and actuating the sleeve is very similar to that illustrated in FIG. 3. That is, sleeve 230 is mounted on guide rods 241 which are linked to an actuator yoke 243, which may be in turn actuated by a variety of different forms of actuator including pneumatic, hydraulic and electric. In the illustrated example the guide rods 241 are slidably supported within bushes 244. The nozzle assembly 34 comprises a first nozzle ring 232 which defines a first side wall of the inlet 9, and a second nozzle ring 233 which closes the annular recess 240 to the inlet 9, and as such defines a second side wall of the inlet 9. An annular seal ring 107 is provided to seal the sleeve 230 with respect to the nozzle ring 233. It will be appreciated that other aspects of operation in this embodiment of the invention will be substantially the same as those of the embodiments in the invention described above in which the sleeve 30 is actuated from the bearing housing side. In particular, the inlet passages 39 will function in substantially the same way.

Referring to FIGS. 16*a* and 16*b*, these show modification of the embodiment shown in FIGS. 15*a* and 15*b* in which the sleeve 330 is positioned on the inside diameter of the nozzle assembly 34 rather than on the outside diameter. In this particular embodiment, the nozzle assembly 34 is located between a side wall 332 of the housing 1, and a facing side wall 332 on the opposite side of annular inlet 9 and which closes annular cavity 240 within which guide rods 241 are slidingly supported. Here again, sleeves 330 may be actuated by any suitable actuator linked to the sleeves by a yoke 243. In this embodiment the cavity 240 is sealed with respect to the inlet 9 by a seal ring 334 supported on the inside diameter of an annular member 335.

As mentioned above, alternative embodiments of the invention may comprise two parallel sleeves, one on the inside diameter and one on the outside diameter, which may be arranged and controlled to move together or independently of one another, and may have different lengths.

Various modifications may be made to the structure of the sleeve. For instance, FIGS. 17*a* and 17*c* show three different possibilities for the profiling of the free end of the sleeve 30. Whereas the sleeve 30 of FIG. 17*a* has a squared-off end, the free end of the sleeve 30 could be curved or otherwise streamlines as shown in FIGS. 17*b* and 17*c*. This may improve aerodynamic efficiency as gas flows past the sleeve through the open portion of the inlet 9.

FIGS. 18*a* and 18*b* show two possible arrangements for a sleeve 30 including a piston ring seal 100 adjacent the free end of the sleeve 30 to prevent gas flow between the sleeve 30 and a nozzle array in the accordance with the invention, indicated generally by reference 101. It will be appreciated that the nozzle assembly 101 may have any of the possible configurations according to the present invention described above. It will also be appreciated that the free end of the sleeve 30 could be profiled as for instance shown in FIGS. 17*b* and 17*c* (and if at the nozzle inner diameter, could be oppositely profiled i.e. on its outer diameter). This, and other shapes, such as a radial ridge (not shown) may be implemented to modify the aerodynamic efficiency of the turbine or to modify the axial or radial aerodynamic forces experienced by the sleeve.

It is also possible to profile or chamfer the opposite side of the sleeve (i.e. the edge that contacts the nozzle) to facilitate smooth running and mitigate the possibility of the sleeve jamming for example against a baffle.

Furthermore, it will be appreciated that these possibilities, including those shown in FIGS. 17*a*-17*c*, 30*a* and 30*b* are applicable to the sleeve regardless of whether it is mounted on the bearing housing or turbine housing side of the nozzle, and regardless of whether it is mounted on the inner or outer diameter of the nozzle or both.

Nozzle structures in accordance with the present invention may be configured to provide varying efficiency for different inlet widths (i.e. corresponding to different positions of the sleeve or sleeves). For instance, it is mentioned above in relation to the embodiment of FIGS. 3 to 6 that baffles may be unequally spaced across the axial width of the inlet. Where the sleeve is capable of moving to positions between the location of baffles, there may be greater inefficiency at such an intermediate position between two relatively widely spaced baffles than between two relatively closely spaced baffles. The ability to tailor the efficiency of the nozzle in this way may have a number of applications.

For instance, turbocharged engines may have an exhaust flow path for returning exhaust gas into the engine inlet. Such systems are generally referred to as "exhaust gas re-circulation" systems, or EGR systems. EGR systems are designed to reduce particulate emissions from the engine by re-circulating a portion of exhaust gas for re-combustion which may often be necessary to meet increasingly stringent emissions legislation. Introduction of re-circulating exhaust gas into the boosted inlet air flow can require a raised exhaust manifold pressure in "short route" EGR systems in which the re-circulating exhaust gas passes from the exhaust to the engine inlet without reaching the turbocharger turbine.

Variable geometry turbochargers can be used to assist in raising the exhaust gas to the required pressure for re-circulation to increase the "back pressure" in the exhaust gas flow upstream of the turbine. When using a variable geometry turbocharger in such a way it has been found that it can be advantageous to reduce the operating efficiency of the turbine at certain inlet widths. In accordance with the present invention this can be achieved by constructing the nozzle e.g. spacing of the inlet baffles, so that the inlet passages 39 are particularly wide (axially) in the region of the mid-stroke position of the sleeve. For instance, between two suitably widely positioned baffles, there will be a range of relatively inefficient positions for the sleeve, typically corresponding to the pair of baffles being a third to a two-thirds open, and the baffle positions may be chosen to provide inefficient operation when the whole inlet is more than half open. Such deliberately produced inefficiency may not have any significant effect on the efficiency of the nozzle when the sleeve is fully open, or indeed fully or nearly fully closed.

In some embodiments of the invention it might be advantageous to decrease the baffle spacing (or otherwise increase the axial size of the inlet passages 39) in regions of the inlet corresponding to closed or relatively closed positions of the sleeve. That is, using a given number of baffles there may be advantages in arranging the baffles closer together near to the fully closed position. For any given number of baffles, this may increase efficiency in relatively closed positions of the sleeve.

It will be understood that whereas embodiments of the present invention have been described in relation to the turbine of a turbocharger, the invention is not limited in application to turbochargers but could be incorporated in turbines of other apparatus. Non-limiting examples of such alternatives include power turbines, steam turbines and gas turbines. In embodiments in which the turbine is part of a turbocharger, the turbocharger might be part of a turbocharged combustion engine, such as a compression ignition (diesel) engine, or a gasoline direction injection (GDi) engine for example. Such applications could include more than one turbocharger including a turbine according to the present invention. Other possible applications include fuel cell turbochargers or turbines.

Turbines according to the present invention may also be used for generating electrical energy (for instance in an automotive system) or in waste heat recovery systems (again particularly for automotive applications, e.g. where a secondary fluid such as water or a refrigerant fluid is boiled by low grade engine/exhaust heat, and expands to drive the turbine). The secondary fluid could even be compressed air as described by the Brayton cycle.

The turbine inlet volute may be a divided volute. For instance, it is known to provide a turbocharger turbine with a volute divided into more than one chamber, each volute chamber being connected to a different set of engine cylinders. In this case, the division is usually an annular wall within the volute separating the volute into axially adjacent portions. It may also be possible to divide the volute circumferentially so that different arcuate portions of the volute deliver gas to different arcuate portions of the turbine inlet.

The turbine of the present invention has been illustrated in the figures using a single flow volute, however it is applicable to housings that are split axially, whereby gas from one or more of the cylinders of an engine are directed to one of the divided volutes, and gas from one or more of the other cylinders is directed to a different volute of the turbine housing. It is also possible to split a turbine housing circumferentially to provide multiple circumferentially divided volutes, or even to split the turbine housing both circumferentially and axially.

However an axially or circumferentially split volute can for instance be distinguished from the axially and circumferentially spaced gas inlet passages of the present invention. For example, the latter relate to a nozzle structure arranged to accelerate exhaust gas from the volute towards the turbine, and also possibly to adjust or control the swirl angle of the gas as it accelerates. Although straight inlet gas passages are in principle possible, generally they are curved so as to control the gas swirl angle efficiently. The gas inlet passages may also distinguished from divided volutes in that the former receive gas from the volute (or divided volute), and split the gas into an array of paths. By contrast divided volutes receive gas from the exhaust manifold, and generally from differing cylinders of an engine so as to retain the gas velocity in gas pulses resulting from individual engine cylinder opening events. As such, a divided volute transmits the gas to the annular inlet, while the gas inlet passages of the present invention accept gas from the volute.

It would be possible to provide the present invention in conjunction with an axially divided volute. In such embodiments the baffle(s) axially dividing the gas inlet passages would generally be distinct from the wall(s) axially dividing the volutes.

It would also be possible to provide the present invention in conjunction with a circumferentially divided volute. A wall dividing two circumferentially spaced volutes could extend radially inwards to further serve as one of the vanes (again provided that the sliding sleeve operates at the inner diameter of the gas inlet passages). Alternatively such a volute dividing wall could extend radially inward and adjacent to the sliding sleeve, so the sleeve is radially inboard of the volute dividing wall, but outboard of the gas inlet passages. Such an arrangement could beneficially mitigate the loss of gas velocity in gas pulses experienced in a single volute turbine, and might also assist in guiding the sliding sleeve to mitigate the possibility of it becoming misaligned and consequently jamming.

The present invention has been described generally in relation to radial inflow turbines. However it is not necessary for the flow to be fully restricted to the radial plane, and a moderately conical inlet may be implemented instead. Furthermore the invention may be applied to "mixed-flow" turbines, whereby the conical inlet has a cone angle in the region of up to 45 degrees or where the turbine housing is axially split into more than one volute, each having a different degree of mixed flow direction. For example one volute might have an inlet substantially in the radial plane while a second volute might have an inlet extending backward in the region of 45 degrees. The present invention could be applied to either one or both of the volutes in such an embodiment.

The invention described in the present could be applied in the case of an axially divided turbine housing, where one volute directs gas axially to the turbine, and another volute directs gas radially or at an intermediate angle to the turbine.

The invention is also applicable to dual (or multi) stage turbines. Therefore it might be applied to the first stage of a multi-stage turbine where the first stage is a radial-inflow turbine stage (or mixed flow turbine stage) and there are one or more additional stages such as axial turbines stage and/or a radial-outlet turbine stage.

As indicated above, the present invention may be implemented to vary the geometry of only one or some of the volutes of an axially divided volute turbine. Indeed it would be possible to provide two variable geometry mechanisms as described herein, utilising two sliding sleeves so as to vary the flow of two axially divided volutes independently.

The present invention could be implemented in conjunction with a sliding variable geometry turbine mechanism of the prior art such as described in U.S. Pat. No. 4,557,665, U.S. Pat. No. 5,868,552, or U.S. Pat. No. 6,931,849. For example the cylindrical sliding wall may additionally be provided with a radial sliding wall. The cylindrical sliding wall acts to vary the number of gas inlet passages exposed, while the sliding radial wall acts to vary the width of a second set of gas inlet passages which are at a different radial extent to the others. Another way to combine the present invention with a sliding variable geometry turbine mechanism of the prior art would be to implement the two types of variable geometry mechanism in two different volutes of an axially divided volute turbine. A third way to implement these mechanisms in conjunction would be to provide them on different turbines of a multiple turbine system, such as a two stage turbocharger.

The present invention could be implemented in conjunction with a swing vane variable geometry mechanism such as described in U.S. Pat. No. 6,779,971 or US2008118349. One possible way to achieve this would be to provide an array of swing vanes each having local baffles (e.g. circular), which are arranged flush with annular baffles. The annular baffles have enough clearance to allow the vanes to rotate between predefined angles. The sliding sleeve as described herein could be permitted to slide inboard or outboard of the annular baffles. This design presents some technical challenges so it might be preferred to implement an array of swing vanes radially inboard or radially outboard of the axially divided array of gas inlet passages as described herein, however the advantage of doing so may be small compared to the cost of doing so. A third, and perhaps better way to combine the present invention with a swing vane system would be to provide a twin inlet (axially divided volute) turbine with an array of swing vanes in one volute, and the sliding sleeve and axially divided baffles described herein in the second volute. A fourth and more yet better way to combine the present invention with a swing vane system would be to provide two turbines (or two turbochargers) in one system (for example in a twin turbo engine system), one of them being a swing vane turbine, and the other being a turbine according to the present invention.

The axially divided gas passages and sliding sleeve described herein might also be implemented in conjunction with a "variable flow turbine" design as described in JP10008977 In these designs a "variable flow turbine" has an inner main volute and an outer (or in rare cases an axially adjacent) "flow extension" volute the entry of which is controlled by a valve similar in shape to conventional flap valves or wastegate valves, the present invention might be implemented to vary the cross sectional area of the flow path back from the outer volute to the inner volute. This might alleviate the need for the outer volute to have such a gap at it's inlet. Alternatively/additionally the present invention might be implemented to vary the flow cross sectional area of the inner volute to the turbine. Additionally/alternatively the present invention might be implemented in a multi-turbine (or multi turbocharger) system, one exhibiting the present invention, and the other exhibiting a "variable flow turbine" such as described in JP10008977.

Furthermore the material of a turbine nozzle according to the invention (or indeed the sliding sleeve) could be ceramic, cermet, instead of metal. Of if of metal could be any steel, or a nickel based alloy such as inconel. It could be provided with a coating, for example on the sliding interface of the nozzle and the sleeve there could be a coating of diamond-like-carbon, anodisation, or tribaloy or a substitute wear resistant coating. On the aerodynamic surfaces there could be a coating to promote smoothness or resist corrosion. Such coatings on the turbine components could include non-deposited coatings such as plasma-electrolytic-oxide coating or substitute coatings. Optionally the nozzle or the sleeve could be provided with a sensor that could be an integrated sensor (such as a pressure, temperature, vibration or speed sensor). Such sensors would need to be insulated electrically from other metallic components.

The turbine inlet may be formed as a contiguous element with an exhaust manifold.

It will be appreciated that any features discussed in relation to one embodiment may be combined with any other appropriate feature(s) of any other embodiment(s).

Other possible modifications and alternatives to the embodiments illustrated and describe above will be readily apparent to the appropriately skilled person.

The invention claimed is:

1. A variable geometry turbine comprising a turbine wheel mounted for rotation about a turbine axis within a housing, the housing defining an annular inlet surrounding the turbine wheel and defined between first and second inlet sidewalls; and a cylindrical sleeve axially movable across the annular inlet to vary the size of a gas flow path through the inlet;

wherein the annular inlet is divided into at least three axially offset annular inlet portions by two or more axially spaced annular baffles disposed between the first and second inlet sidewalls;

inlet vanes extending axially into at least one of the inlet portions and defining circumferentially adjacent inlet passages; and wherein each of at least two of said baffles extends radially inboard of inlet vanes which extend into at least one of the inlet portions axially adjacent the respective baffle, and wherein a distance between an inner diameter of a first baffle of said at least two of said baffles and a trailing edge of a radially innermost vane in one of said annular inlet portions adjacent the first baffle is greater than a distance between an inner diameter of a second baffle of said at least two of said baffles and a trailing edge of a radially innermost vane in one of said annular inlet portions adjacent the second baffle.

2. A variable geometry turbocharger according to claim 1, wherein said one of said annular inlet portions adjacent the first baffle is axially displaced from the first baffle in a first direction and wherein said one of said annular inlet portions adjacent the second baffle is axially displaced from the second baffle in the first direction.

3. A variable geometry turbine according to claim 1, wherein at least two baffles which extend radially inboard of inlet vanes in a respective adjacent inlet portions have different inner diameters.

4. A variable geometry turbine according to claim 1, wherein the axial profile formed by the inner diameters of at least two baffles which extend radially inboard of inlet vanes in a respective adjacent inlet portion generally corresponds to an axial profile of a surface that would be swept by the rotation of the turbine wheel.

5. A variable geometry turbine according to claim 1, wherein the relative inner diameters of at least three baffles which extend radially inboard of inlet vanes in a respective adjacent inlet portion generally increase in an axial direction.

6. A variable geometry turbine according to claim 1, wherein at least two of the at least two of said baffles have an inner diameter such that the radial distance relative to the turbine axis between the inner diameter of the baffle and the trailing edge of a radially innermost vane of an inlet portion adjacent the baffle is more than generally 50% of the radial distance between the trailing edge of said radially innermost vane and the outer diameter of the turbine wheel at the axial position of the baffle.

7. A variable geometry turbine comprising a turbine wheel mounted for rotation about a turbine axis within a housing, the housing defining an annular inlet surrounding the turbine wheel and defined between first and second inlet sidewalls; and a cylindrical sleeve axially movable across the annular inlet to vary the size of a gas flow path through the inlet;

wherein the annular inlet is divided into at least two axially offset annular inlet portions by one or more axially spaced annular baffles disposed between the first and second inlet sidewalls;

inlet vanes extending axially into at least one of the inlet portions and defining circumferentially adjacent inlet passages; and wherein at least one of the one or more baffles extends radially inboard of inlet vanes which extend into at least one of the inlet portions axially adjacent the respective baffle, and wherein at least one of said at least one of the one or more baffles has an inner diameter such that the radial distance relative to the turbine axis between the inner diameter of the baffle and the trailing edge of a radially innermost vane of an inlet portion adjacent the baffle is more than generally 50% of the radial distance between the trailing edge of said radially innermost vane and the outer diameter of the turbine wheel at the axial position of the baffle.

8. A variable geometry turbine according to claim 7, wherein the radial distance relative to the turbine axis between the inner diameter of the baffle and the trailing edge of a radially innermost vane of an inlet portion adjacent the baffle is more than generally 60% of the radial distance between the trailing edge of said radially innermost vane and the outer diameter of the turbine wheel at the axial position of the baffle.

9. A variable geometry turbine according to claim 7, wherein the radial distance relative to the turbine axis between the inner diameter of the baffle and the trailing edge of a radially innermost vane of an inlet portion adjacent the baffle is more than generally 70% of the radial distance between the trailing edge of said radially innermost vane and the outer diameter of the turbine wheel at the axial position of the baffle.

10. A variable geometry turbine according to claim 7, wherein the radial distance relative to the turbine axis between the inner diameter of the baffle and the trailing edge of a radially innermost vane of an inlet portion adjacent the baffle is more than generally 80% of the radial distance between the trailing edge of said radially innermost vane and the outer diameter of the turbine wheel at the axial position of the baffle.

11. A variable geometry turbine according to claim 7, wherein the radial distance relative to the turbine axis between the inner diameter of the baffle and the trailing edge of a radially innermost vane of an inlet portion adjacent the baffle is more than generally 90% of the radial distance between the trailing edge of said radially innermost vane and the outer diameter of the turbine wheel at the axial position of the baffle.

12. A variable geometry turbine according to claim 7, wherein the radial distance relative to the turbine axis between the inner diameter of the baffle and the trailing edge of a radially innermost vane of an inlet portion adjacent the baffle is more than generally 95% of the radial distance between the trailing edge of said radially innermost vane and the outer diameter of the turbine wheel at the axial position of the baffle.

* * * * *